US011732503B2

(12) United States Patent
Rocchitelli et al.

(10) Patent No.: US 11,732,503 B2
(45) Date of Patent: Aug. 22, 2023

(54) DEVICE FOR CLOSING AND OPENING AND/OR FOR LOCKING AND UNLOCKING DOORS, IN PARTICULAR DOORS OF HOUSEHOLD APPLIANCES SUCH AS WASHING MACHINES OR THE LIKE

(71) Applicant: ELETTROTECNICA ROLD S.R.L., Nerviano (IT)

(72) Inventors: Stefano Rocchitelli, Pogliano Milanese (IT); Vito Masi, Bernate Ticino (IT); Marco Mauceri, Garbagnate Milanese (IT)

( * ) Notice: Subject to any disclaimer, the term of this patent is extended or adjusted under 35 U.S.C. 154(b) by 329 days.

(21) Appl. No.: 17/087,947

(22) Filed: Nov. 3, 2020

(65) Prior Publication Data

US 2022/0136283 A1 May 5, 2022

(51) Int. Cl.
*E05B 47/00* (2006.01)
*A47L 15/42* (2006.01)
(Continued)

(52) U.S. Cl.
CPC ..... *E05B 47/0002* (2013.01); *A47L 15/4259* (2013.01); *D06F 37/42* (2013.01);
(Continued)

(58) Field of Classification Search
CPC ..... E05B 47/0002; E05B 2047/0069; A47L 15/4259; D06F 37/42; D06F 39/14; E05C 1/006
See application file for complete search history.

(56) References Cited

U.S. PATENT DOCUMENTS

2004/0134239 A1* 7/2004 Hapke ..... D06F 34/20 134/58 DL
2004/0163684 A1* 8/2004 Hapke ..... A47L 15/4259 134/57 DL
(Continued)

FOREIGN PATENT DOCUMENTS

CN 108118498 A * 6/2018 ..... D06F 37/42
CN 108505288 A * 9/2018 ..... D06F 37/42
(Continued)

*Primary Examiner* — Mark A Williams
(74) *Attorney, Agent, or Firm* — Themis Law

(57) ABSTRACT

A device for closing and opening doors and/or hatches and/or similar components, in particular of household appliances such as washing machines, in particular with top loading, dishwashers and similar household appliances, said device comprising a closing and opening assembly adapted to be fixed to one of a fixed part and the hatch of a household appliance and including a closing and opening element which is adapted to be switched by translation between a first end-stop position and a second end-stop position and vice versa; wherein said device comprises a permission element which is adapted to be switched by translation between a first end-stop own position thereof and a second end-stop own position thereof and vice versa, and wherein said permission element, during the translation thereof from said first end-stop own position thereof to said second end-stop own position thereof, is adapted to be locked in a third intermediate own position thereof between said first and second end-stop own positions thereof.

20 Claims, 37 Drawing Sheets

(51) Int. Cl.
*D06F 37/42* (2006.01)
*D06F 39/14* (2006.01)
*E05C 1/00* (2006.01)

(52) U.S. Cl.
CPC ..... *D06F 39/14* (2013.01); *E05C 1/006* (2013.01); *E05B 2047/0069* (2013.01)

(56) References Cited

U.S. PATENT DOCUMENTS

| | | | | |
|---|---|---|---|---|
| 2006/0288742 | A1* | 12/2006 | Hapke | D06F 34/20 134/58 DL |
| 2016/0222573 | A1* | 8/2016 | Dirnberger | D06F 39/14 |
| 2017/0188785 | A1* | 7/2017 | Park | A47L 15/4259 |
| 2017/0306552 | A1* | 10/2017 | Leibman | D06F 34/28 |
| 2018/0171534 | A1* | 6/2018 | Chae | D06F 33/47 |
| 2018/0266035 | A1* | 9/2018 | Wang | E05C 21/00 |

FOREIGN PATENT DOCUMENTS

| | | | | |
|---|---|---|---|---|
| CN | 108670164 | A * | 10/2018 | A47L 15/00 |
| DE | 102017203778 | A1 * | 9/2018 | |
| KR | 20180060558 | A * | 6/2018 | |
| WO | WO-2018104974 | A1 * | 6/2018 | A47L 15/4259 |

* cited by examiner

DEVICE FOR CLOSING AND OPENING AND/OR FOR LOCKING AND UNLOCKING DOORS, IN PARTICULAR DOORS OF HOUSEHOLD APPLIANCES SUCH AS WASHING MACHINES OR THE LIKE

TECHNICAL FIELD OF THE INVENTION

The present invention relates to the field of household appliances, such as washing machines, dishwashers, and/or similar household appliances. In particular, the present invention finds advantageous application in the field of household appliances of the aforesaid type with top loading. In detail, the present invention relates to a closing and opening and/or a locking and releasing device, in particular for hatches, doors or the like, for example of household appliances of the aforesaid type. In greater detail, the present invention relates to a device of the aforesaid type adapted to allow performing at least some of the functions of the household appliance only in the presence of a safe and reliable electric acknowledgement or permission, of closed and/or absent and/or incorrectly positioned hatch, as well as of verified locking of the hatch. The present invention also relates to a closing and opening and/or locking and releasing system comprising said device, and to a household appliance provided with said system.

BACKGROUND ART

The most widespread closing and opening and/or locking and releasing devices and/or systems (hereinafter referred to for short as closing and opening) used for household appliances, such as washing machines, in particular of the top loading type, and/or similar household appliances, essentially comprise a true closing (and opening) assembly, usually applied to the casing of the household appliance, and a reference member usually fixed to the hatch of the household appliance itself. According to the most widespread solutions, the closing and opening (locking and releasing) assembly further comprises a closing element or latch which is adapted to be switched by translation between a first opening position and a second closing position and vice versa, wherein, in the closing position, the closing element engages the corresponding reference member of the hatch, thus ensuring the closing and locking of the hatch itself, while, contrarily, with the latch in the opening position, the reference member is not engaged and it is thus possible to open the hatch.

Closing devices and/or systems are also known, including a control unit adapted to generate an electric acknowledgement in the absence of which at least some of the functions of the household appliance are inhibited or at least limited, wherein said electric acknowledgement is automatically generated as soon as the latch reaches the closing position, in which it engages the reference member on the hatch.

The assignee of the present patent application is the assignee of the preceding applications IT 102019000006178 and PCT/IB2010/053658, the subject of which is depicted in FIGS. 1 to 10, where reference numeral 1000 identifies a closing system including a closing assembly 100 (as anticipated, which is adapted to be applied to the casing of the household appliance) and a reference member 200 usually fixed to the hatch of the household appliance itself and comprising a cavity 201. The closing assembly further comprises a closing and opening element 110 (substantially a latch) which can be switched by translation between a first end-stop position (FIG. 6), in which it does not engage the cavity 201, and a second end-stop position, in which, instead, it engages the cavity 201 (FIG. 8), wherein, with the latch 110 engaged in the cavity 201, the opening of the hatch is clearly inhibited by the mutual contrast between the latch 110 and the reference member 200.

Furthermore, the assembly 100 comprises a permission element 300 which is also adapted to be switched by translation and connected to the latch 110 so that the translational switching of the latch 110 from the first end-stop position to the second end-stop position results in the translation of the element 300 in the same direction and in particular, from the first end-stop position thereof (FIG. 6) to the second end-stop position thereof, the element 300, in particular, being pulled to be translated by the latch 110.

With the hatch 2000 in the closing position in FIG. 6, and therefore with the cavity 201 of the reference member 200 positioned in front of the latch 110, the translation of the latch 110 towards the second end-stop position results in the cavity 201 being engaged by the free end of the latch 110 and, as anticipated, in the element 300 being pulled towards the second end-stop position thereof. However, the element 300, during the translation thereof, collides against the reference member 200, and is thus locked (while the latch 110 continues the travel thereof) in a third intermediate position thereof, in which it is kept in thrust against the reference member 200 (FIGS. 7 and 8).

Sliding electric contacts in the form of metal plates are also fixed to the element 300, wherein the assembly 100 comprises electric circuitry with corresponding electric terminals.

The positioning of the element 300 in the third own intermediate position thereof results in the aforesaid sliding electric contacts being repositioned in contact with the aforesaid terminals, and therefore in an electric circuit being closed with related generation of an electric acknowledgement or permission.

The electric permission is also used for enabling and disabling at least some of the functionalities of the household appliance, respectively, wherein, for example, with the element 300 in the third own intermediate position thereof, the wash cycle may be started, while, instead, with the element 300 in one of the first and second own end-stop positions thereof, and thus, in the absence of the electric permission, the wash cycle may not be started.

Although the closing devices and/or systems of the known type depicted in FIGS. 1-10 may be appreciated from different viewpoints (constructional and operating simplicity, good reliability, relatively low manufacturing and/or installation costs), they have certain drawbacks which are to be solved by the present invention.

A first drawback relates to the fact that the electric acknowledgement of "hatch 2000 in the closing position" and the corresponding electric permission are generated by the latch 110 and/or the element 300 and thus irrespective of the actual position of the hatch, wherein, with the hatch 2000 in the opening position, the electric permission is thus generated in the case of accidental positioning of the element 300 in the intermediate own position thereof and/or of the latch 110 in the end-stop position.

A further drawback or factor of dissatisfaction relates to the fact that, with the hatch in the opening position and with the latch 110 and the element 300 correctly positioned in the corresponding second end-stop positions, and therefore with the functions of the household appliance inhibited by the absence of electric permission, the forced repositioning of the element 300 in the third intermediate own position thereof results in the generation of the electric permission and therefore in the enabling of the functions of the device even though the hatch 2000 is in the opening position.

Therefore, it is the main object of the present invention to overcome or at least minimize the problems summarized above, found in the closing devices and/or systems according to the known art.

In particular, it is a first object of the present invention to provide a closing and opening device and/or system which allows the acknowledgement of the actual presence of the hatch in the closing position.

It is a further object of the present invention to provide a solution which allows a reliable acknowledgement of the actual opening and closing position.

It is a further object of the present invention to provide a solution which allows a reliable acknowledgement of the actual locking and/or releasing state of the hatch.

It is a further object of the present invention to provide a solution which inhibits the functions of the closing and opening device, in particular by inhibiting the switching of the permission element in the third intermediate position thereof in the case of forced opening of the hatch with the possible breakage of the latch.

Lastly, the closing and opening device and/or system according to the present invention should be characterized by manufacturing costs which are compatible with the needs of the market, small size, and overall volume, as well as by being applicable to household appliances of known type according to equally simple methods and with equally low costs, in addition to not requiring substantial variations of said household appliances.

SUMMARY OF THE PRESENT INVENTION

The present invention is based on the general consideration that the above preset objects may be achieved and the functional and reliability needs may be met in compliance with the safety legislation by a device which, in addition to the locking latch and the permission element, also includes a magnetic field sensor adapted to detect and/or perceive the proximity of a magnet fixed to the hatch, and/or a solution adapted to lock the permission element in the third intermediate position thereof.

Based on the above considerations, and in order to overcome or at least minimize the problems and/or drawbacks identified in the closing and opening devices and/or systems according to the prior art, according to a first embodiment, the present invention relates to a device for closing and opening doors and/or hatches and/or similar components, in particular of household appliances, such as washing machines, in particular with top loading, dishwashers and similar household appliances, said device comprising a closing and opening assembly adapted to be fixed to one of a fixed part and the hatch of a household appliance and comprising a closing and opening element which is adapted to be switched by translation between a first end-stop position and a second end-stop position and vice versa; wherein said device comprises a permission element which is adapted to be switched by translation between a first own end-stop position thereof and a second own end-stop position thereof and vice versa, and wherein said permission element, during the translation thereof from said first own end-stop position thereof to said second own end-stop position thereof, is adapted to be locked in a third own intermediate position thereof between said first own end-stop position and second own end-stop position thereof; wherein with said permission element locked in said intermediate own position thereof, said closing and opening element, on reaching said second end-stop position, is automatically switched by translation to said first end-stop position and locked in an intermediate position between said first and second end-stop positions.

According to an embodiment, said closing and opening element, during the translation thereof from said first end-stop position to said second end-stop position, pulls said permission element to be translated from the first end-stop own position thereof to the second end-stop own position thereof.

According to an embodiment, said closing and opening assembly comprises first elastic means, wherein the translation of said closing and opening element from said first end-stop position to said second end-stop position occurs against the elastic resistance of said first elastic means, and wherein the automatic switching of said closing and opening element from said second end-stop position to said first end-stop position is due to the elastic thrust of said first elastic means.

According to an embodiment, said device comprises second elastic retaining means which are adapted to be switched by rotation between a first position and a second position, wherein with said permission element locked in said third intermediate own position thereof, the switching of said closing and opening element to said second end-stop position results in said second elastic retaining means being switched from said first position to said second position, wherein, with said second elastic retaining means in said second position, said closing and opening element, during the automatic switching from said second end-stop position to said first end-stop position, is locked by said second elastic retaining means in said third intermediate position.

According to an embodiment, with said permission element not locked in said third own intermediate position thereof, but instead free to reach said second end-stop own position thereof, the switching of said closing and opening element from said first end-stop position to said second end-stop position, and the switching of said permission element from said first end-stop own position thereof to said second end-stop own position thereof do not result in said second elastic retaining means being switched from said first position to said second position, wherein, with said permission element in said second own end-stop position thereof, said closing element, during the automatic switching from said second end-stop position to said first end-stop position, is thus not locked by said second elastic retaining means in said third intermediate position.

According to an embodiment, said closing and opening assembly comprises third elastic means interposed between said closing and opening element and said permission element, wherein the translation of said closing and opening element from said first end-stop position to said second end-stop position results in a thrust exerted by said closing and opening element on said third elastic means, and in a thrust exerted on said permission element by said third elastic means.

According to an embodiment, the locking of said permission element in said third intermediate own position thereof does not interfere with the translation of said closing element towards said second closing position, wherein, instead, with said permission element locked in said third intermediate own position thereof, said closing and opening element is translatable with respect to said permission element.

According to an embodiment, with said permission element locked in said third intermediate own position thereof, the translation of said closing and opening element towards said second position occurs against the elastic resistance exerted by said third elastic means.

According to an embodiment, said permission element is adapted to be locked in said second own end-stop position thereof.

According to an embodiment, said permission element comprises an elastic tongue which is adapted to be switched by elastic deformation between a first position and a second position, wherein said closing and opening assembly comprises a fixed contrast portion, and wherein the translation of said permission element towards said second end-stop own position thereof and beyond said third intermediate own position thereof, results in said elastic tongue being switched from said first position to said second position by contrast against said fixed contrast portion of said closing and opening assembly.

According to an embodiment, said deformable tongue passing beyond said fixed contrast portion results in said deformable tongue being automatically switched from said second position to said first position and in said permission element being locked by contrast between said deformable tongue and said fixed portion.

According to an embodiment, said device comprises at least a first electric circuit, the closing of which results in at least one function of said household appliance being enabled wherein said at least a first circuit is electrically closed with said permission element locked in said third intermediate own position thereof.

According to an embodiment, said at least one circuit comprises a plurality of terminals, wherein said device comprises a plurality of contact elements fixed to said permission element and wherein, only with said permission element locked in said third own position thereof, said at least one electric circuit is electrically closed by mutual contact between said terminals of said at least one circuit and said contact elements.

According to an embodiment, said closing and opening element has a predetermined breaking point, and wherein said closing and opening element is adapted to break at said predetermined breaking point if it is subjected to transverse loads equal to or greater than a predetermined transverse load.

According to an embodiment, said closing and opening assembly comprises a magnetic field sensor adapted to perceive the proximity of a permanent magnet.

According to an embodiment, said device comprises at least a second electric circuit, the closing of which results in at least one function of said household appliance being enabled, wherein said at least a second circuit is electrically closed by said magnetic field sensor upon perceiving the proximity of one said permanent magnet.

The present invention also relates to a system for closing and opening doors and/or hatches and/or similar components, in particular of household appliances, such as washing machines, dishwashers and similar household appliances, said system comprising a reference member adapted to be fixed firmly to said one hatch and/or a fixed part of said one household appliance, wherein said system comprises a closing and opening device according to one of the embodiments of the present invention, and wherein said reference member is adapted to be alternately engaged by and disengaged from said closing and opening element.

According to an embodiment, said reference member defines a cavity, wherein said closing and opening element comprises an end portion adapted to be housed in said cavity.

According to an embodiment, said reference member defines an engagement element adapted to be engaged by said permission element during the translation thereof from said first end-stop own position thereof to said second end-stop own position thereof, and to lock said permission element in said third intermediate own position thereof.

The present invention also relates to a household appliance such as a washing machine including at least one hatch, said household appliance comprising at least one hatch which is switchable between a first opening position and a second closing position, wherein said household appliance comprises a system according to one of the embodiments of the present invention, wherein said reference member is fixed to said hatch or to a fixed part of said household appliance, wherein said device is fixed to a fixed part of said household appliance or to said hatch of said household appliance, respectively, and wherein said reference member and device are mutually positioned so that, with said hatch in said closing position, said reference member is adapted to be engaged by said opening and closing element in said second closing position and by said permission element in said third intermediate position thereof.

Any further embodiments of the present invention are defined in the claims.

BRIEF DESCRIPTION OF THE DRAWINGS

The present invention is further clarified below by the following detailed description of possible embodiments depicted in the drawings, in which features and/or corresponding or equivalent component parts of the present invention are identified by the same reference numerals. In any case, it is worth noting that the present invention is not limited to the embodiments described below and depicted in the drawings; on the contrary, all those variants and/or modifications of the embodiments described below and depicted in the accompanying drawings, which will be apparent and obvious to those skilled in the art, fall within the scope of the present invention.

In the drawings.

DETAILED DESCRIPTION OF THE PRESENT INVENTION

The present invention is particularly applied to the field of household appliances, such as washing machines, dishwashers, and similar household appliances, in particular washing machines with top loading, this being the reason why the present invention is described below with possible particular reference to the applications thereof in the field of household appliances, in particular of washing machines.

Nonetheless, it is highlighted that the possible applications of the present invention are not limited to those described below. On the contrary, the present invention is conveniently applied in all cases requiring the reliable, simple, safe, and legally-compliant closing and opening and/or locking and releasing of a hatch.

Figure 1:
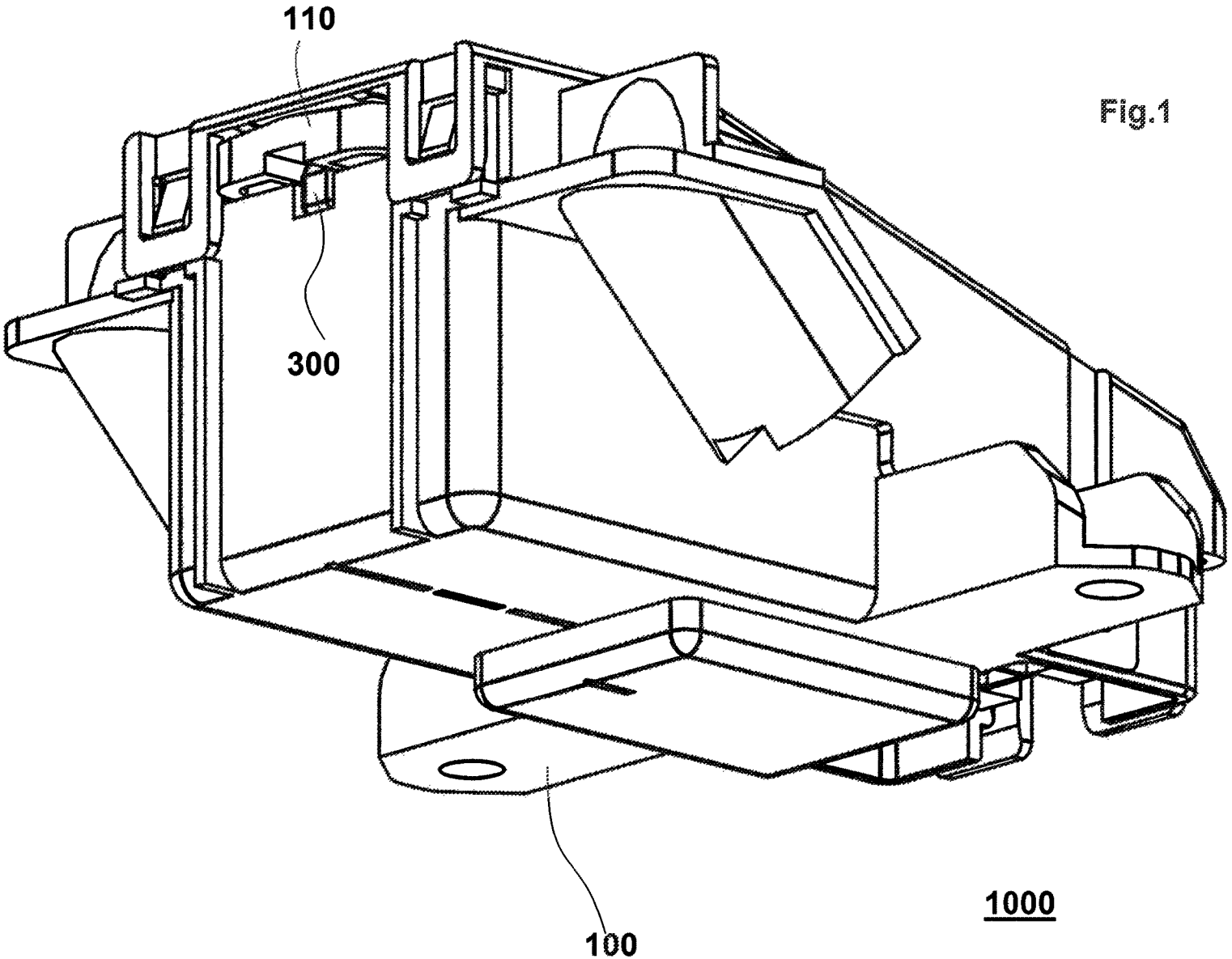
FIGS. 1 to 10 show perspective, partial sectional side, and plan views of a closing and opening device according to the prior art.
Figure 2:
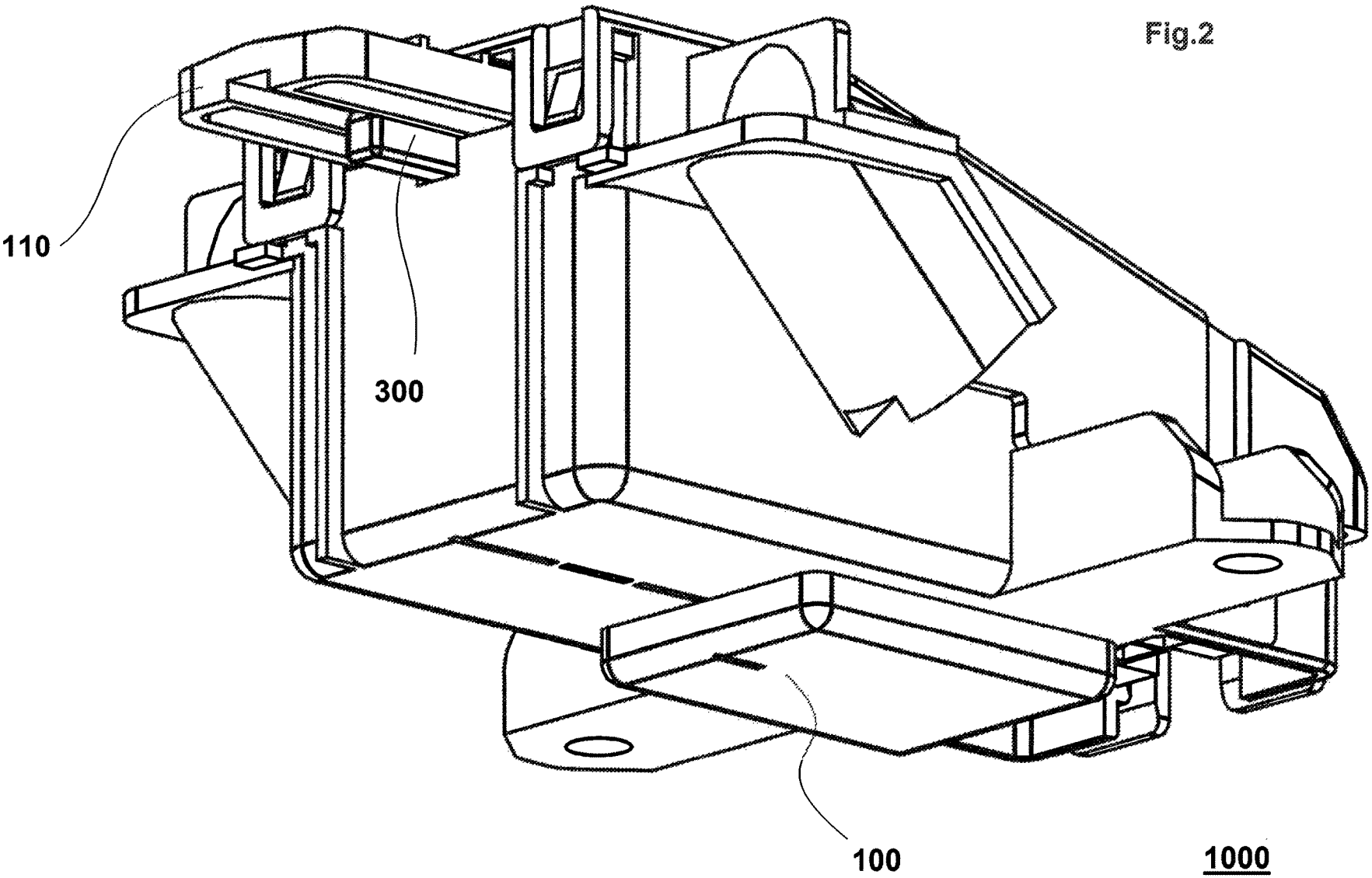
Figure 3:
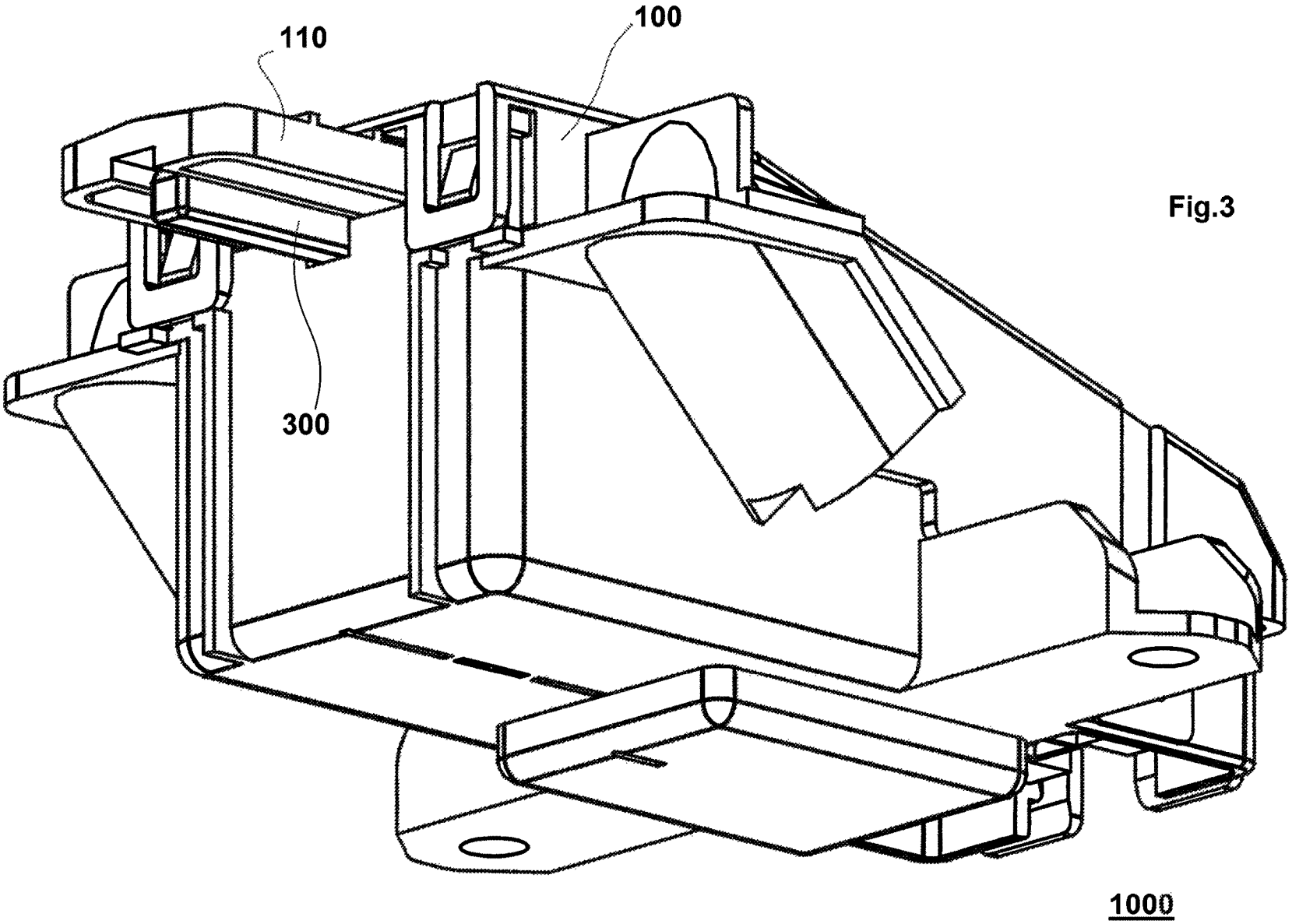
Figure 4:
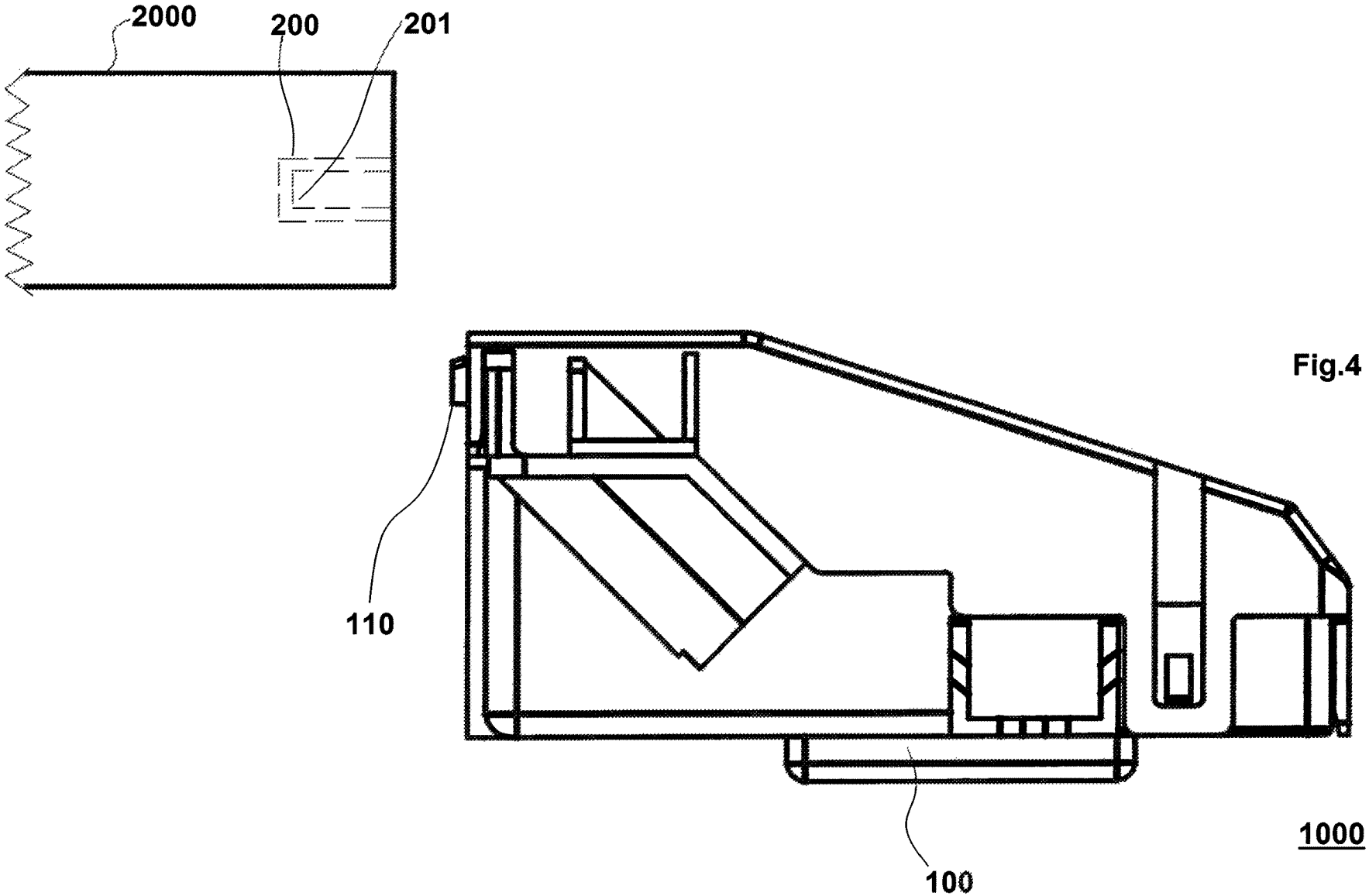
Figure 5:
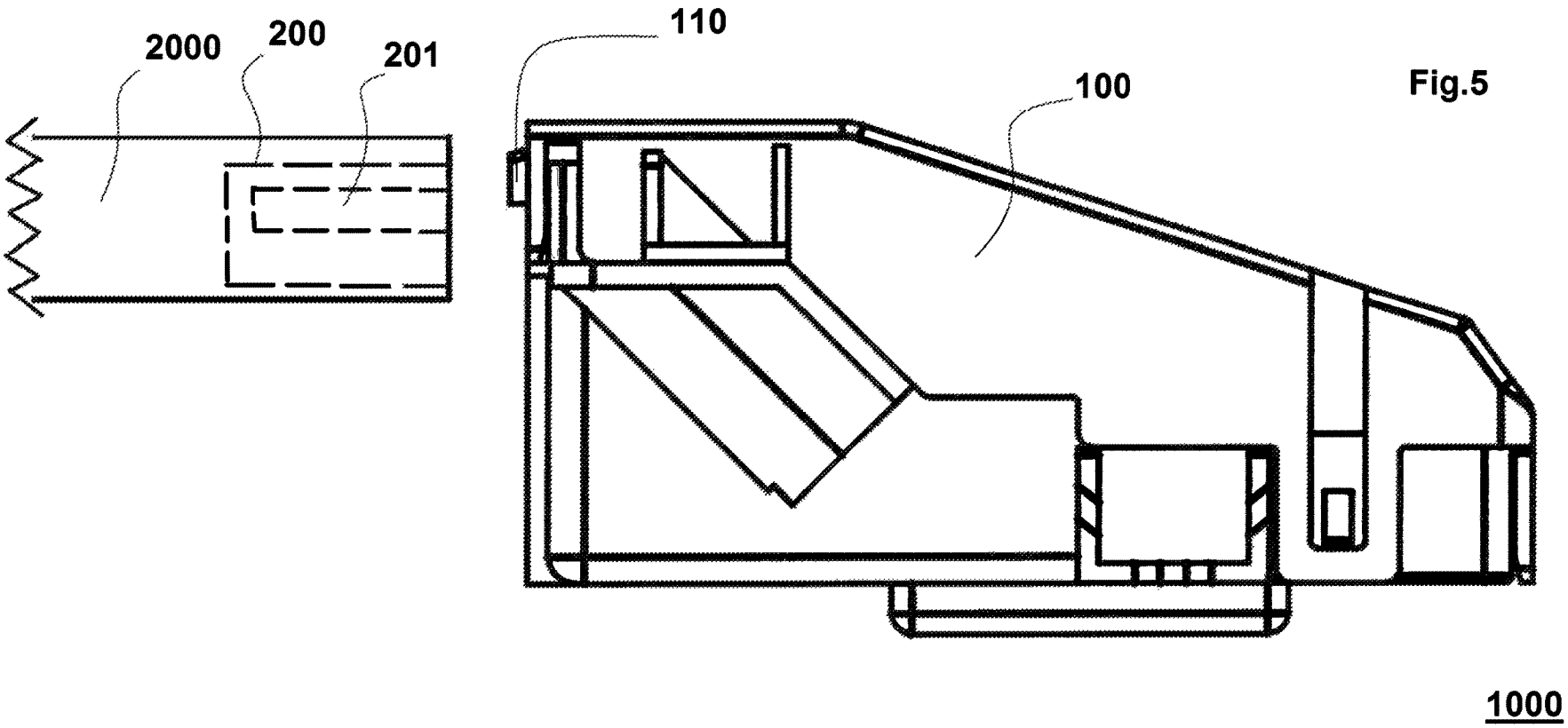
Figure 6:
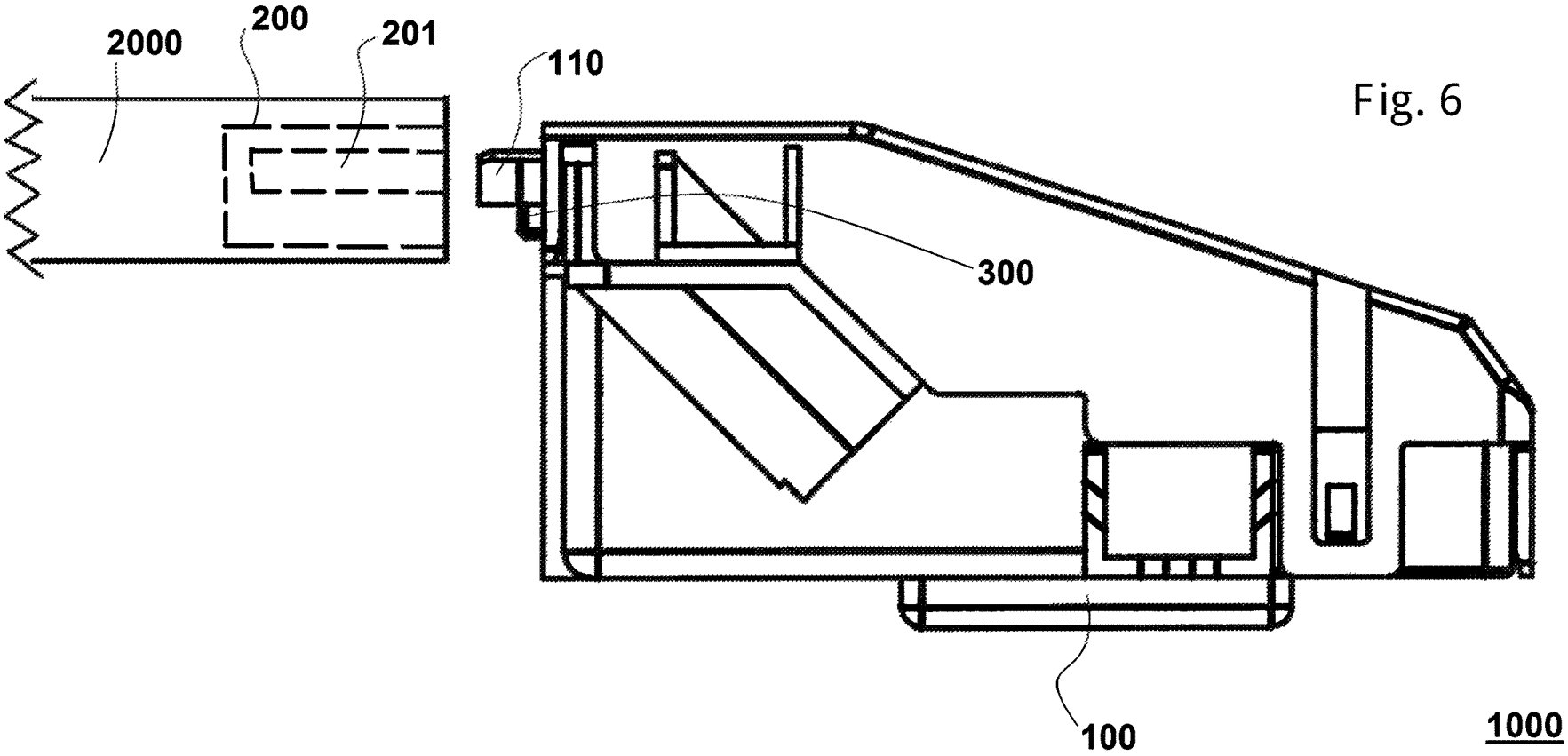
Figure 7:
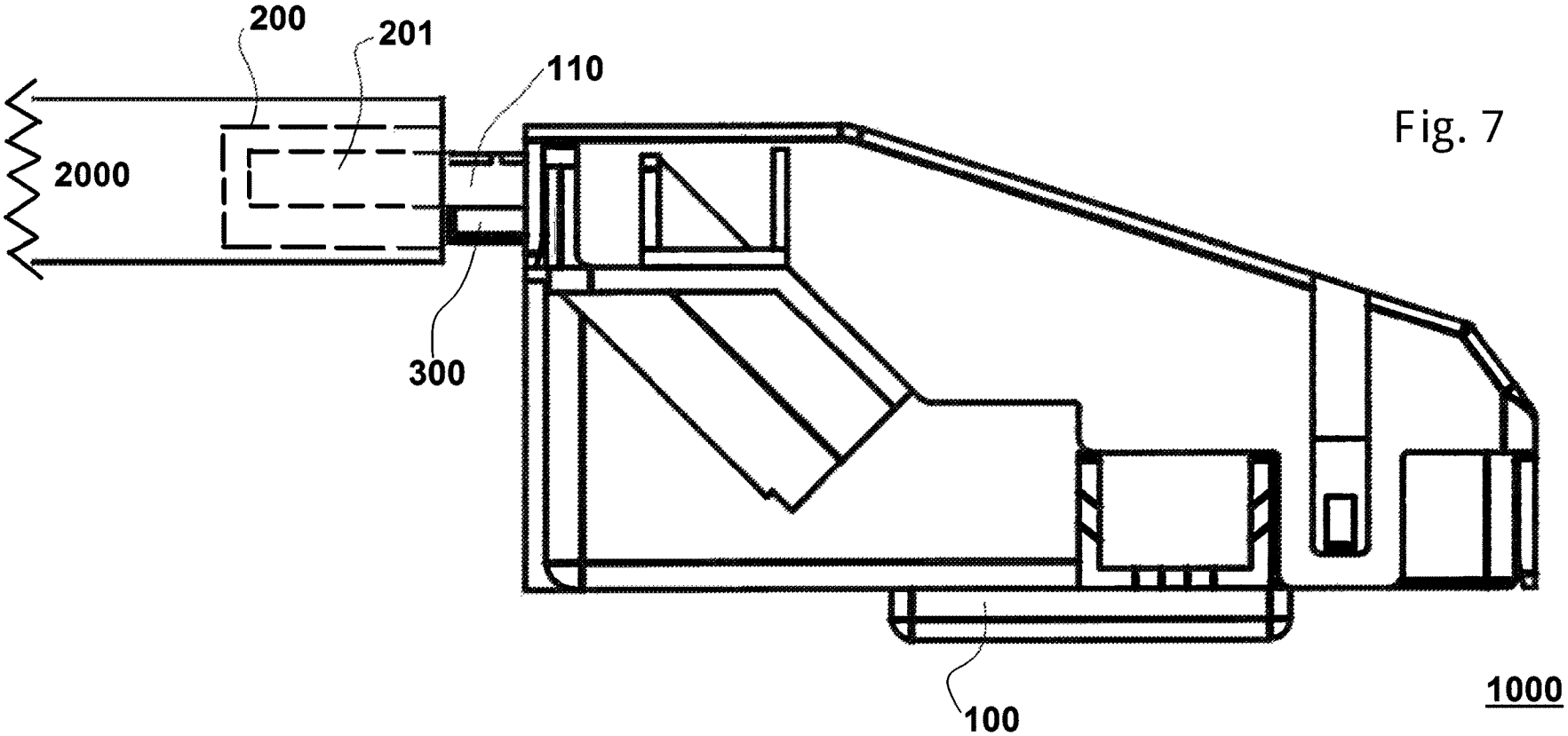
Figure 8:
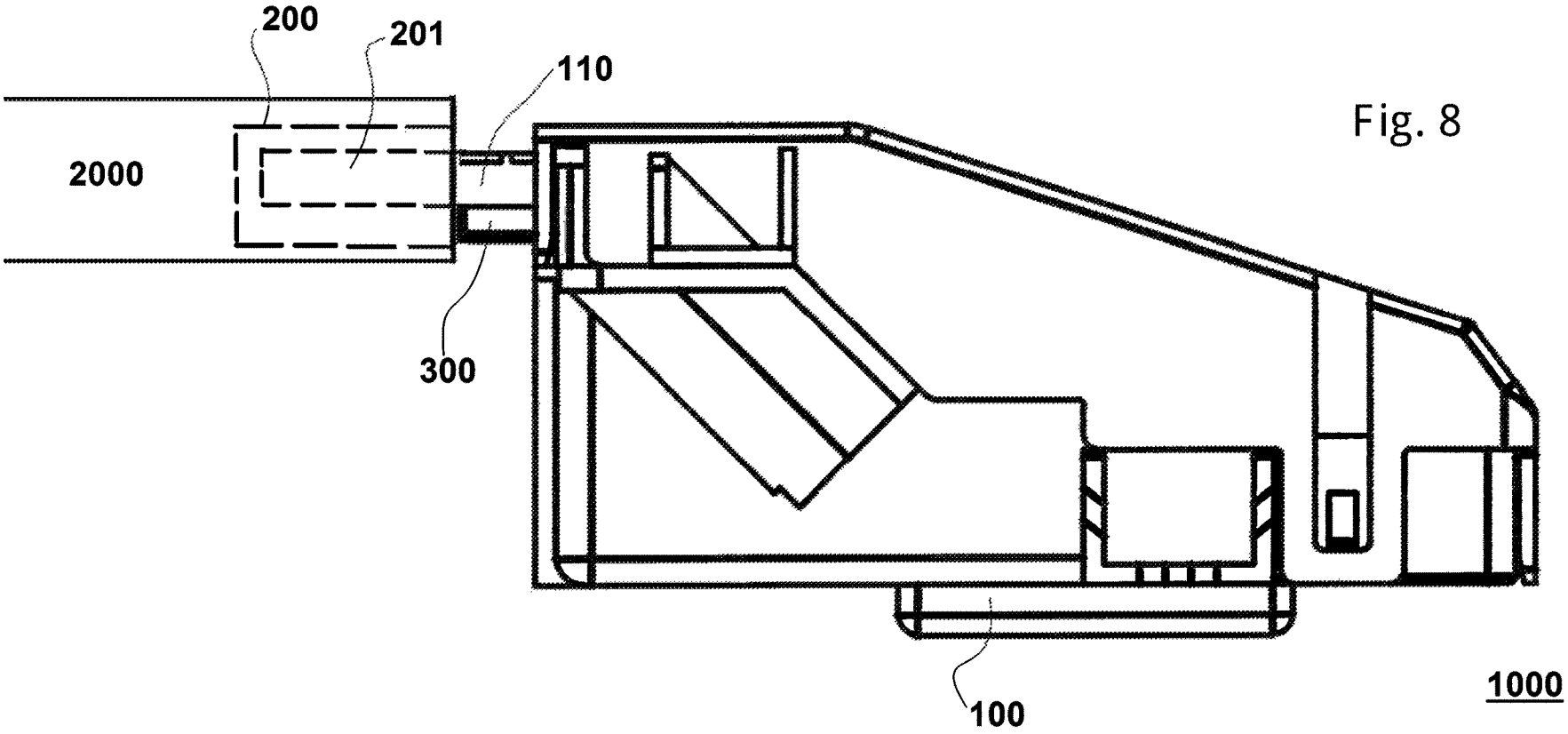
Figure 9:
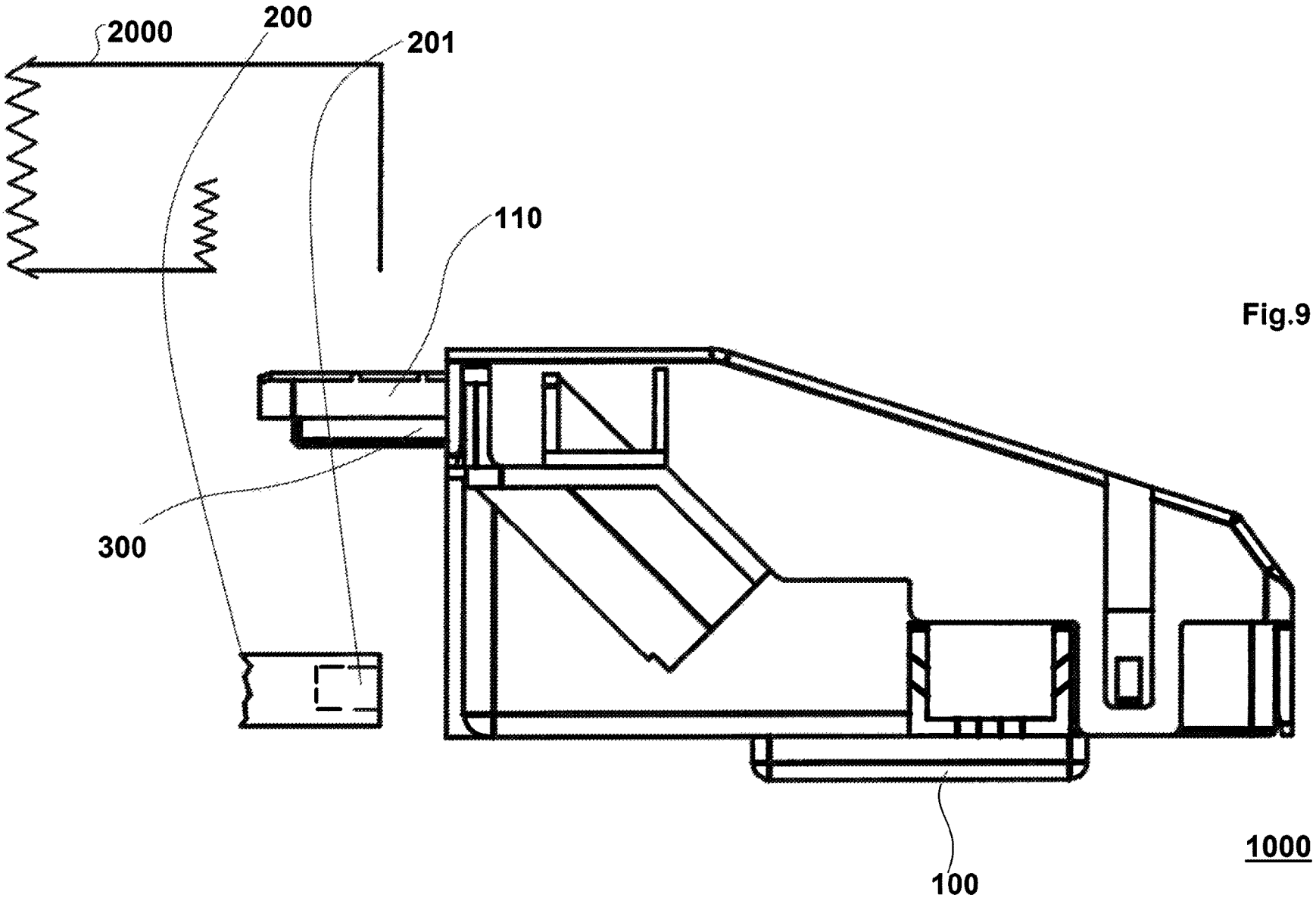
Figure 10:
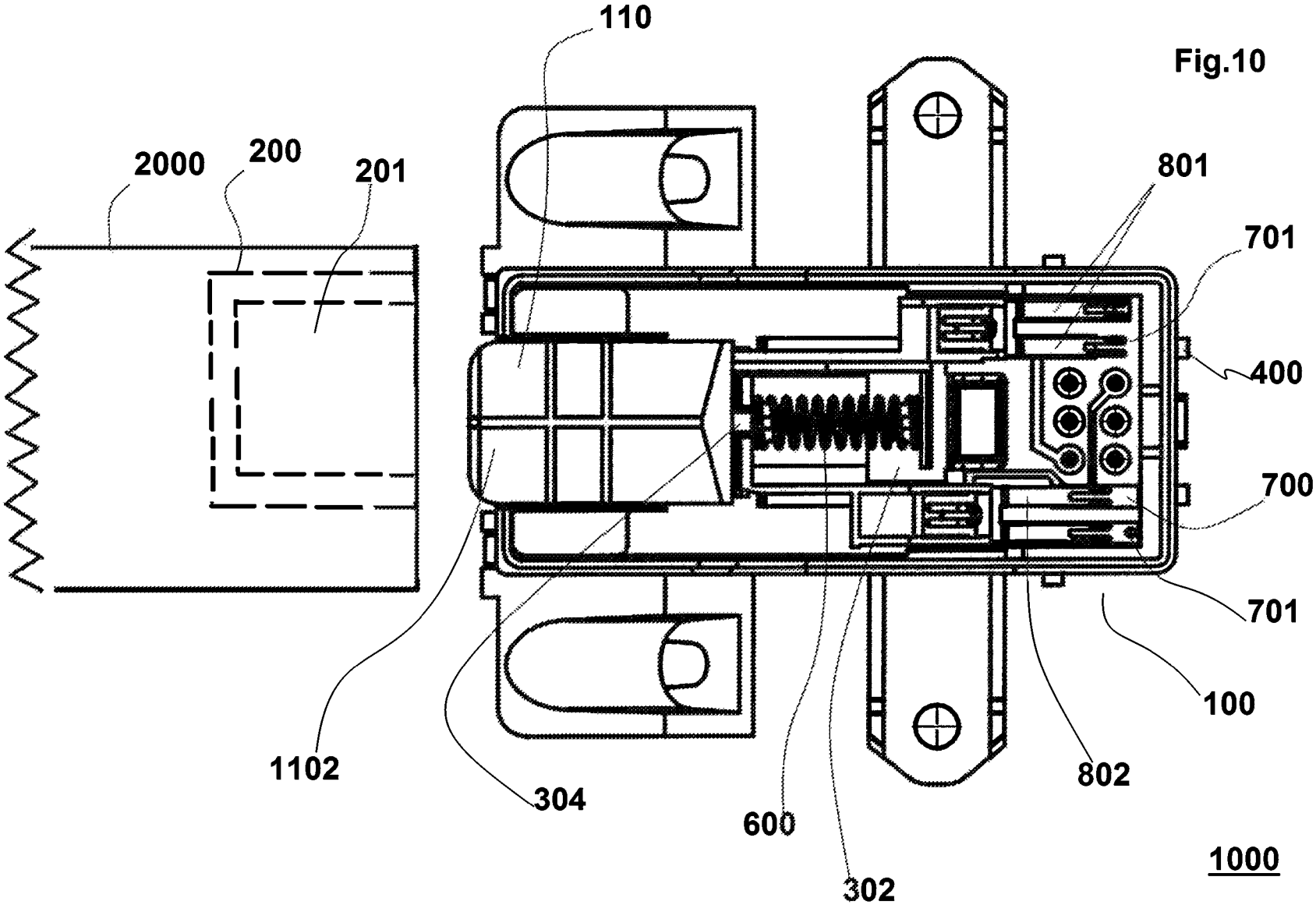
Figure 11:
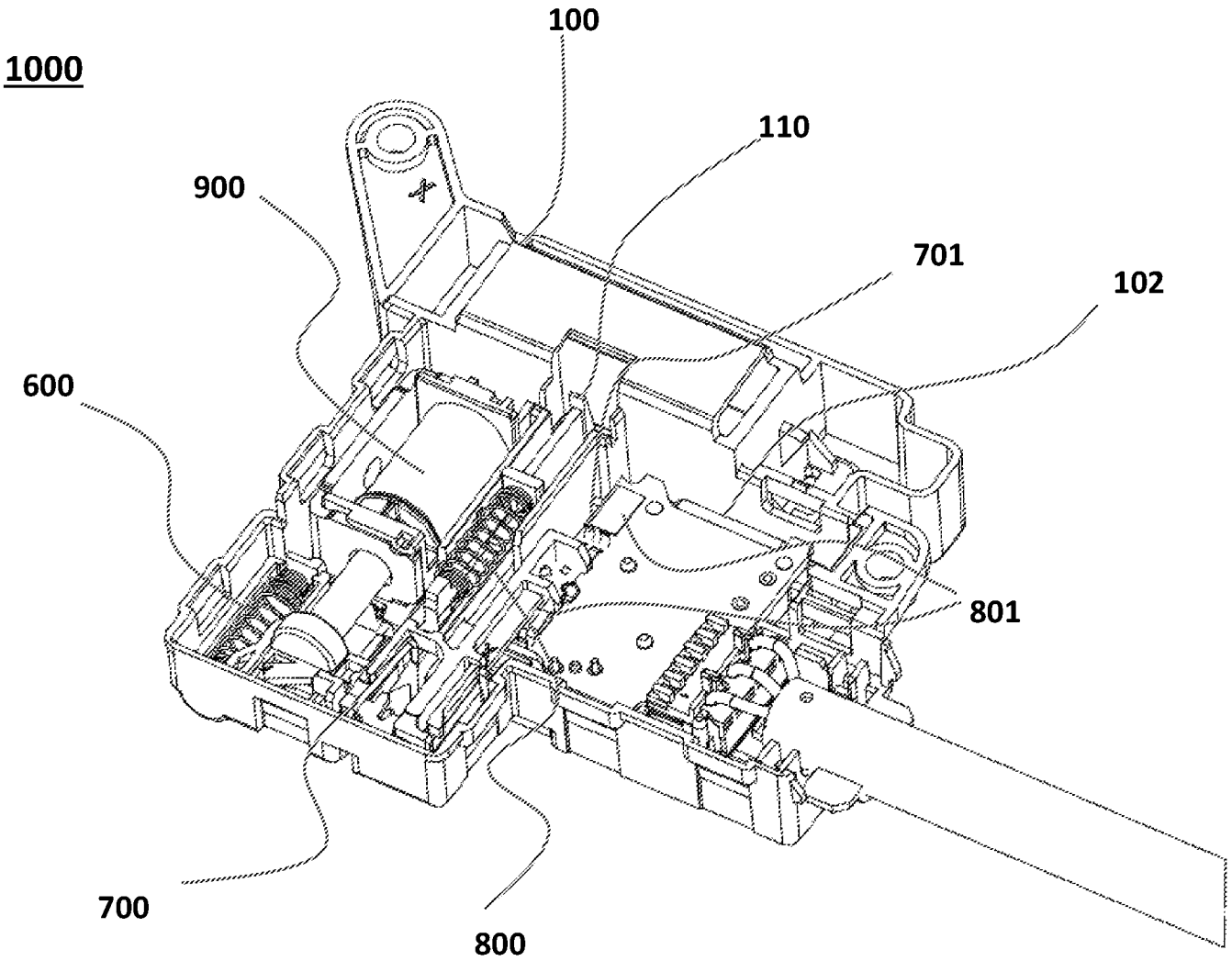
FIG. 11 shows a perspective view of the device according to an embodiment of the present invention, with the closing element and the permission element in different positions, respectively.
Figure 12:
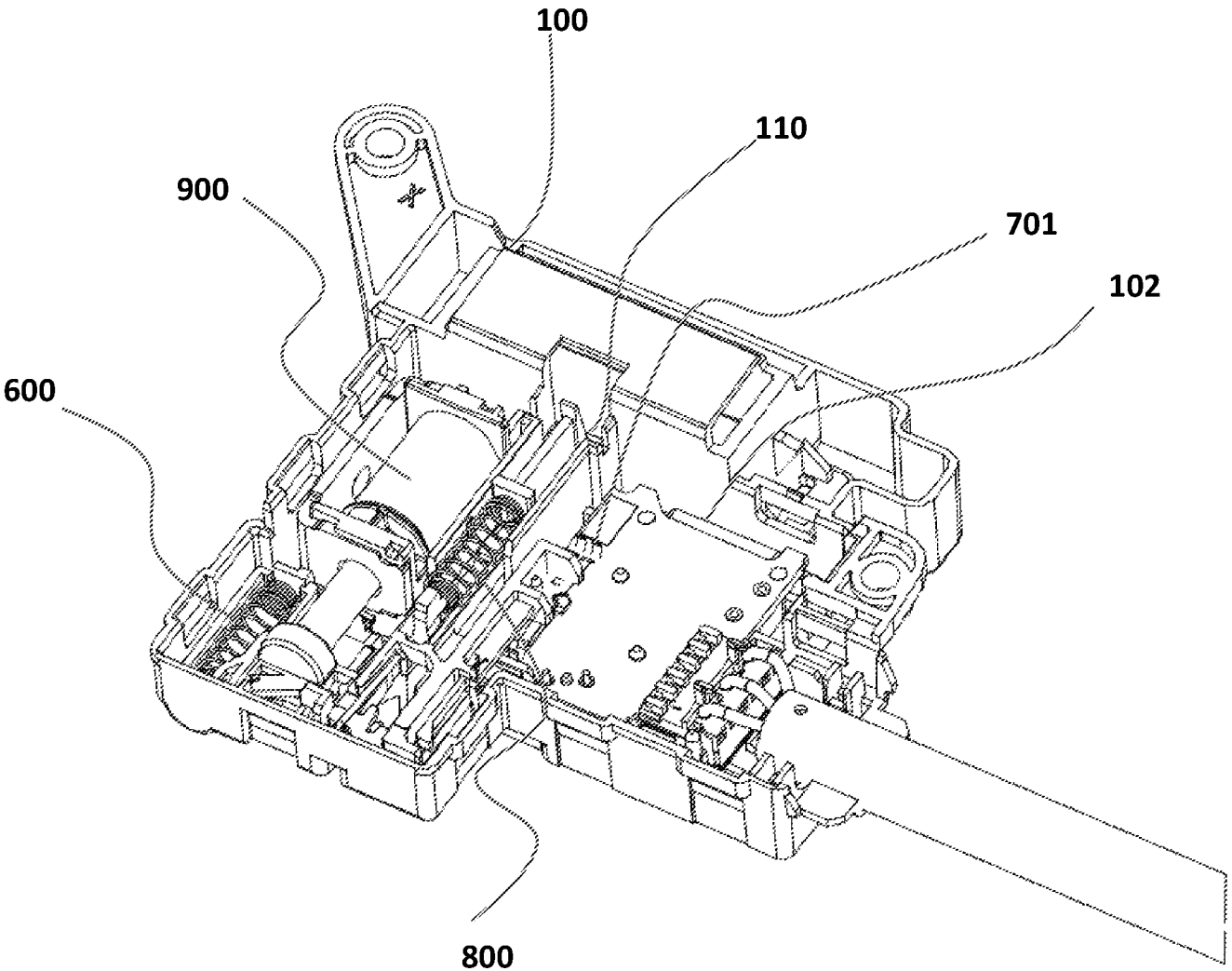
FIG. 12 shows a perspective view of the device according to an embodiment of the present invention.
Figure 13A:
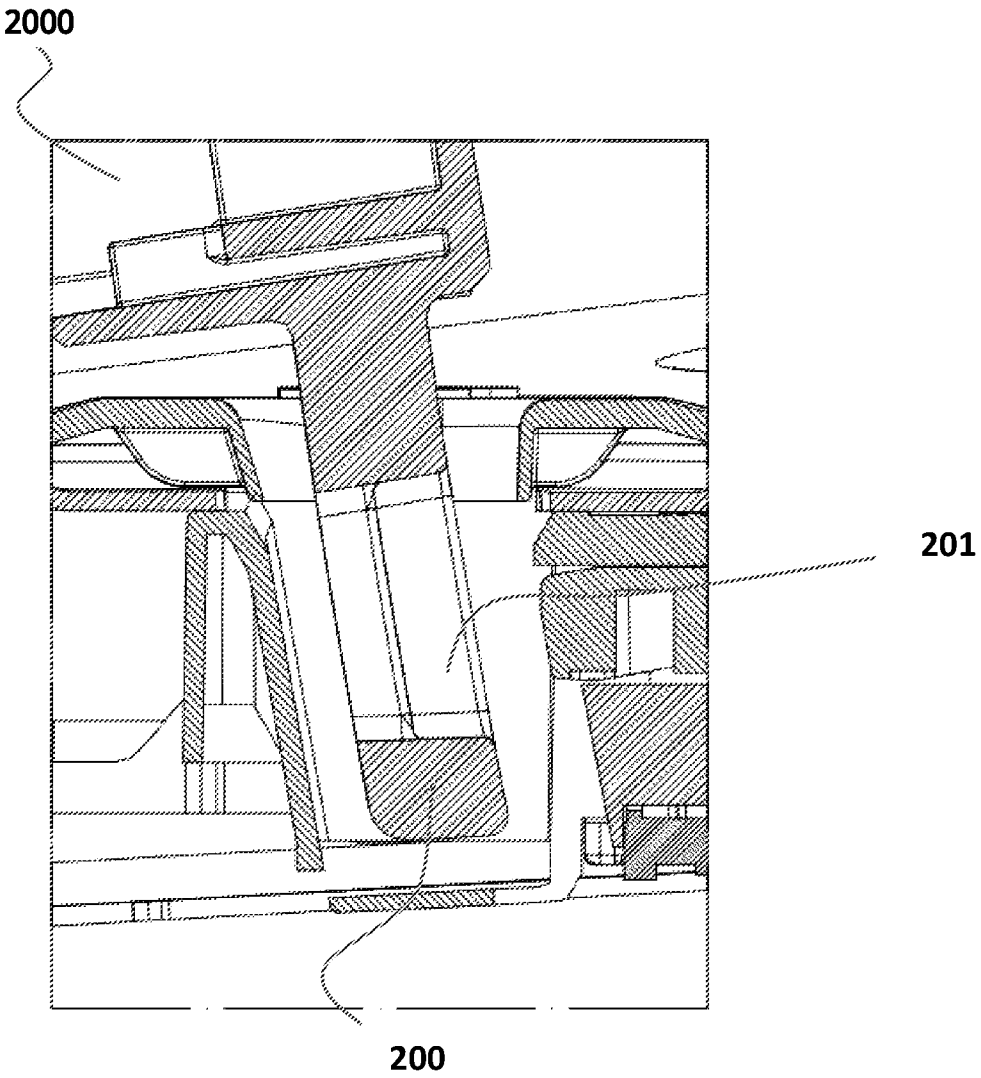
FIGS. 13*a* to 13*c* show a partial sectional side view and plan views, respectively, of the device according to an embodiment of the present invention.
Figure 13B:
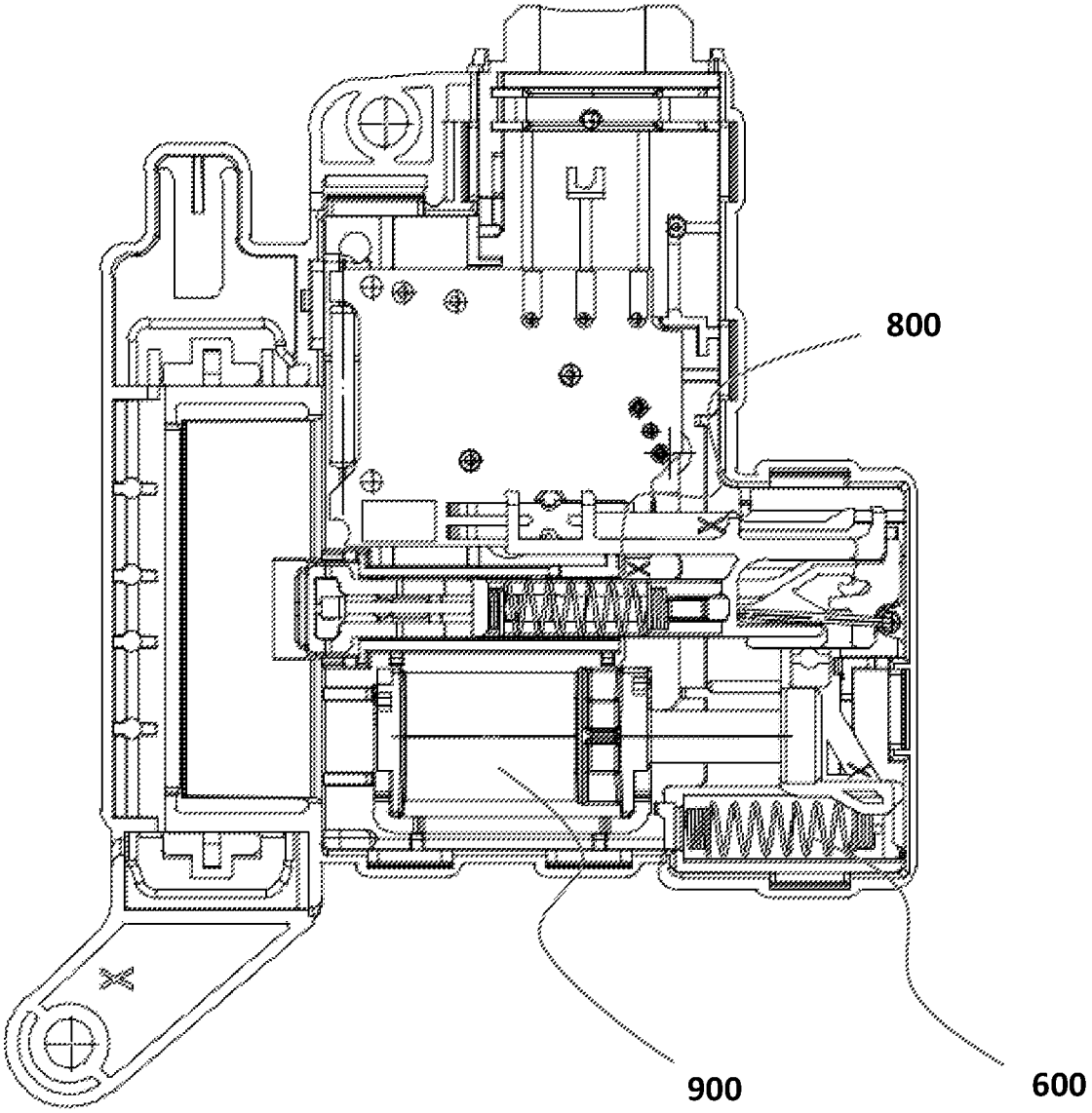
Figure 13C:
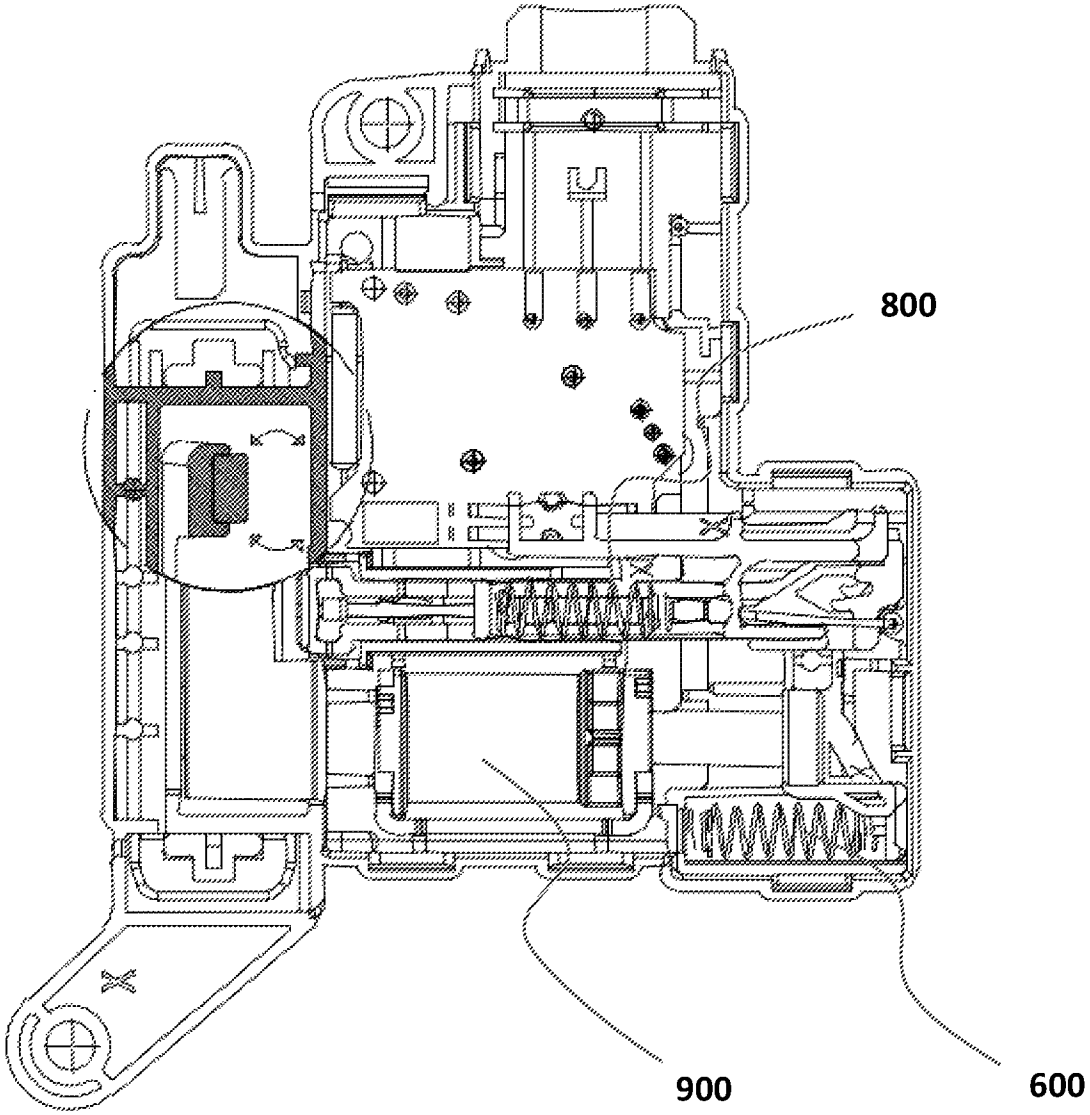
Figure 14A:
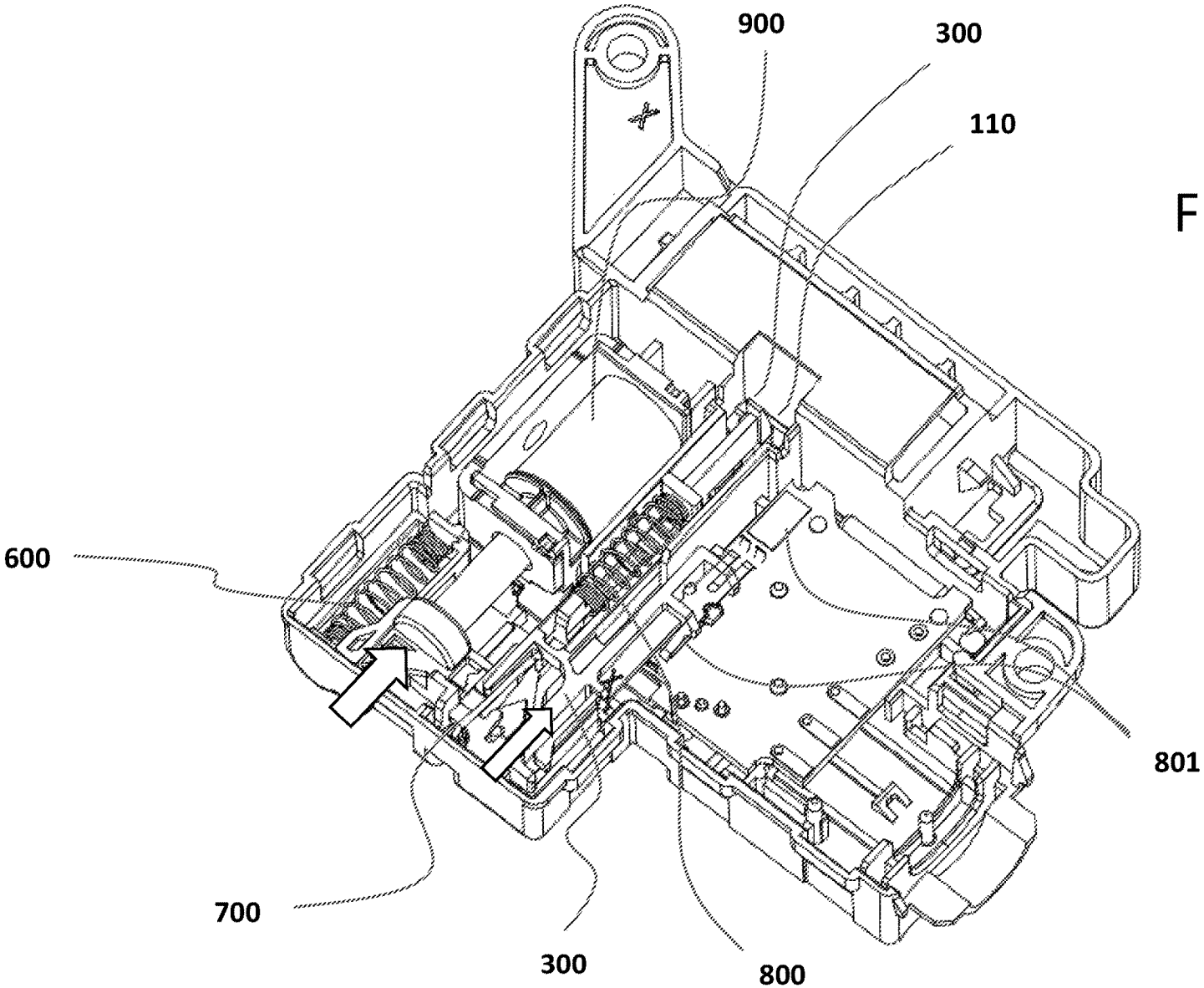
FIGS. 14*a* to 14*b* show a perspective view of a device according to an embodiment of the present invention and a detail of said device.
Figure 14B:
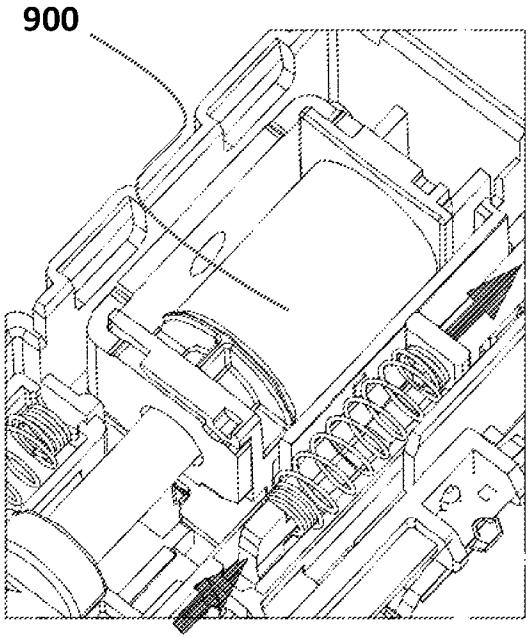
Figure 15A:
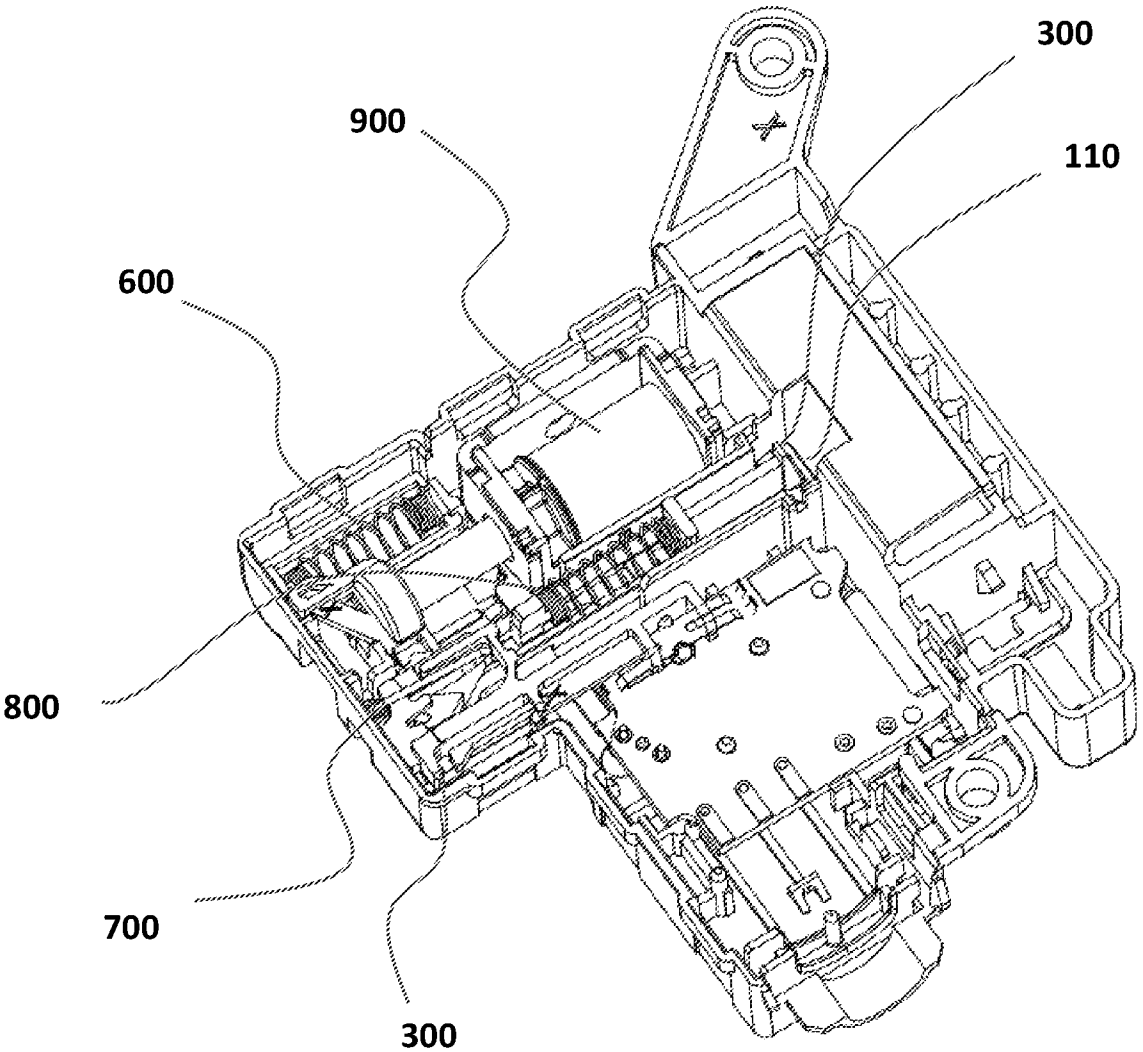
FIGS. 15*a* to 15*d* show perspective views of the device according to an embodiment of the present invention during the different steps of the locking procedure.
Figure 15B:
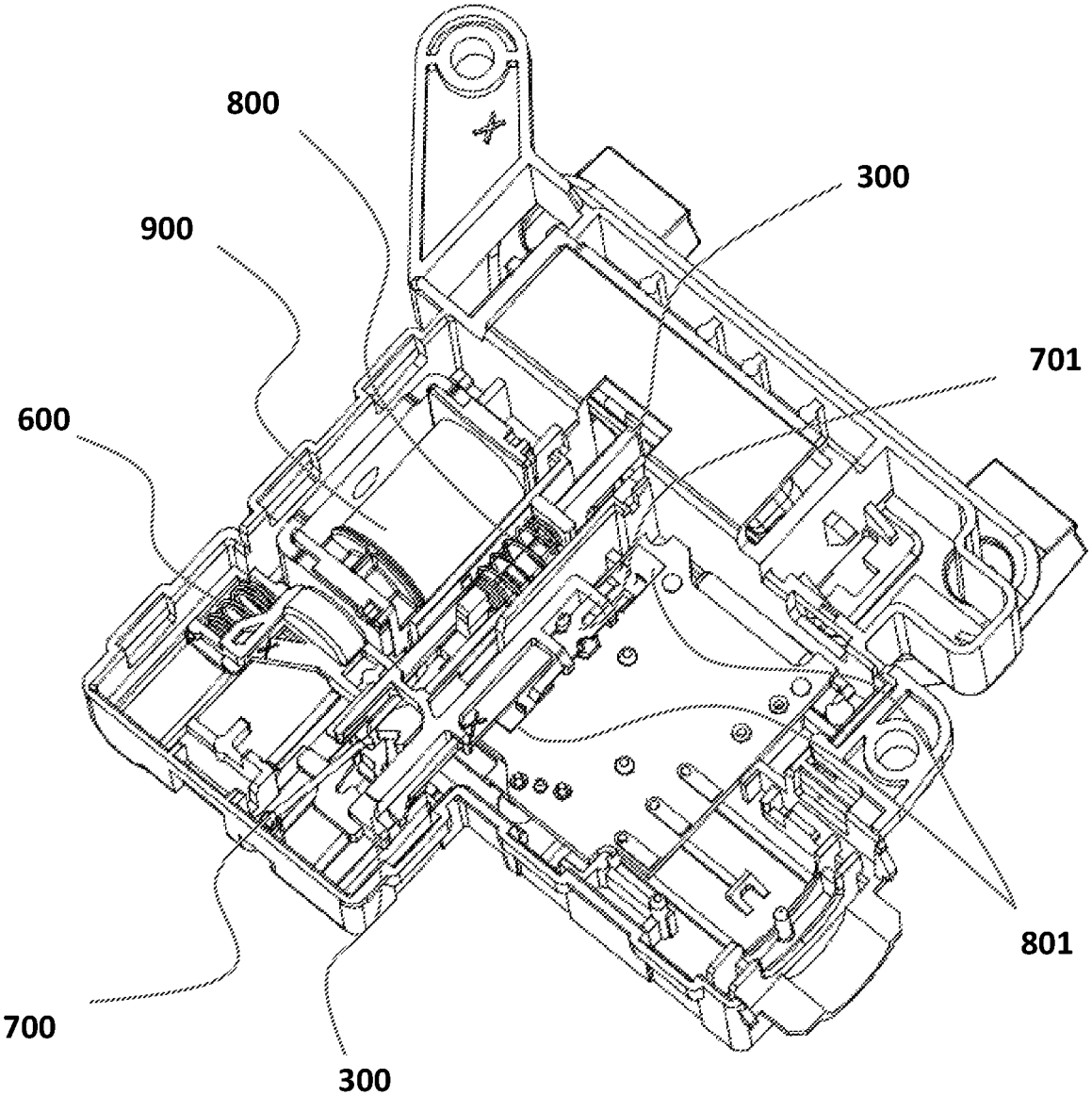
Figure 15C:
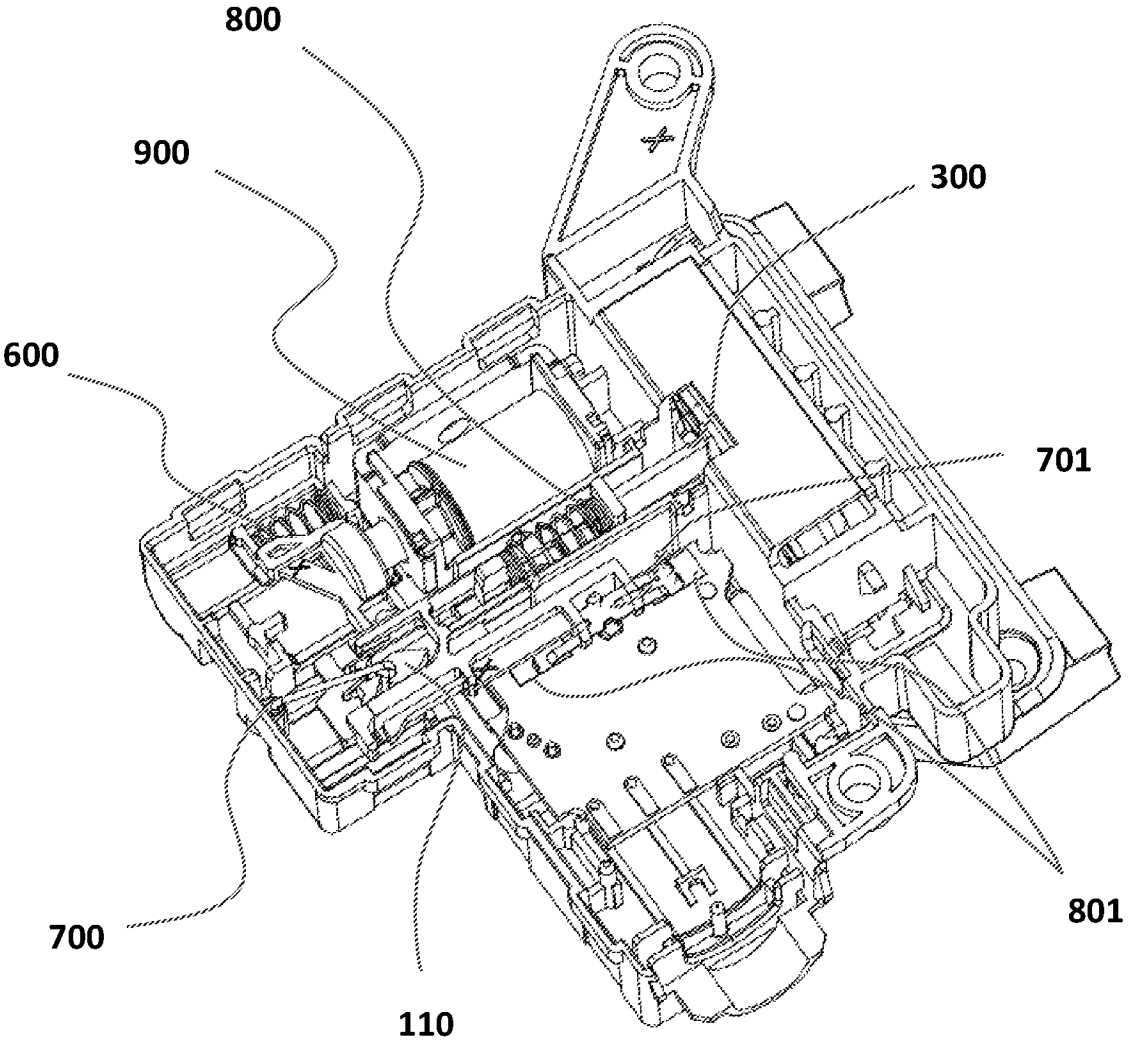
Figure 15D:
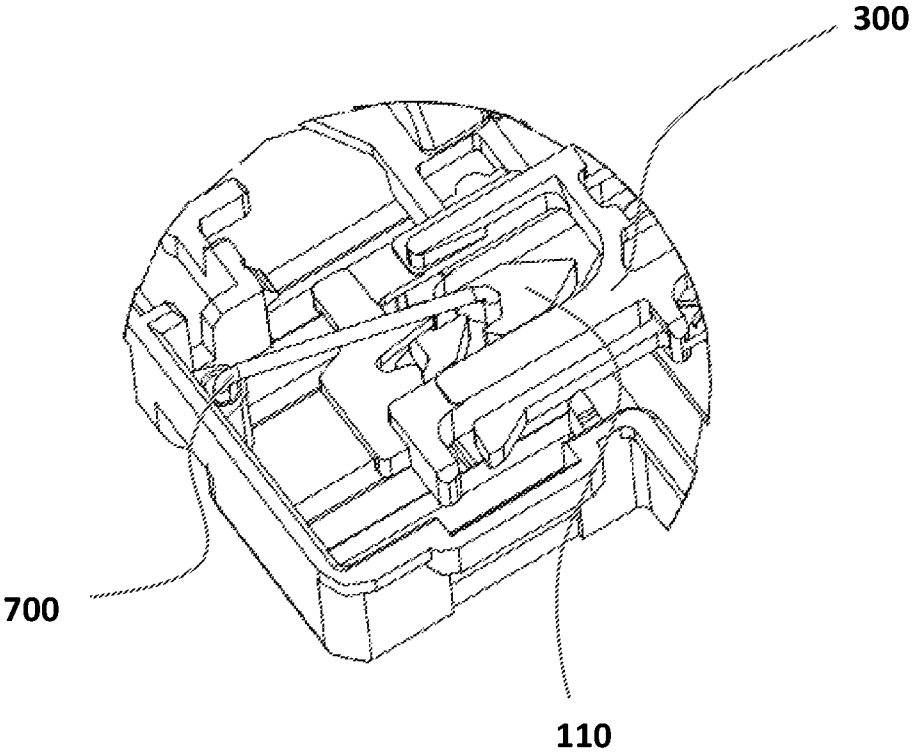
Figure 16A:
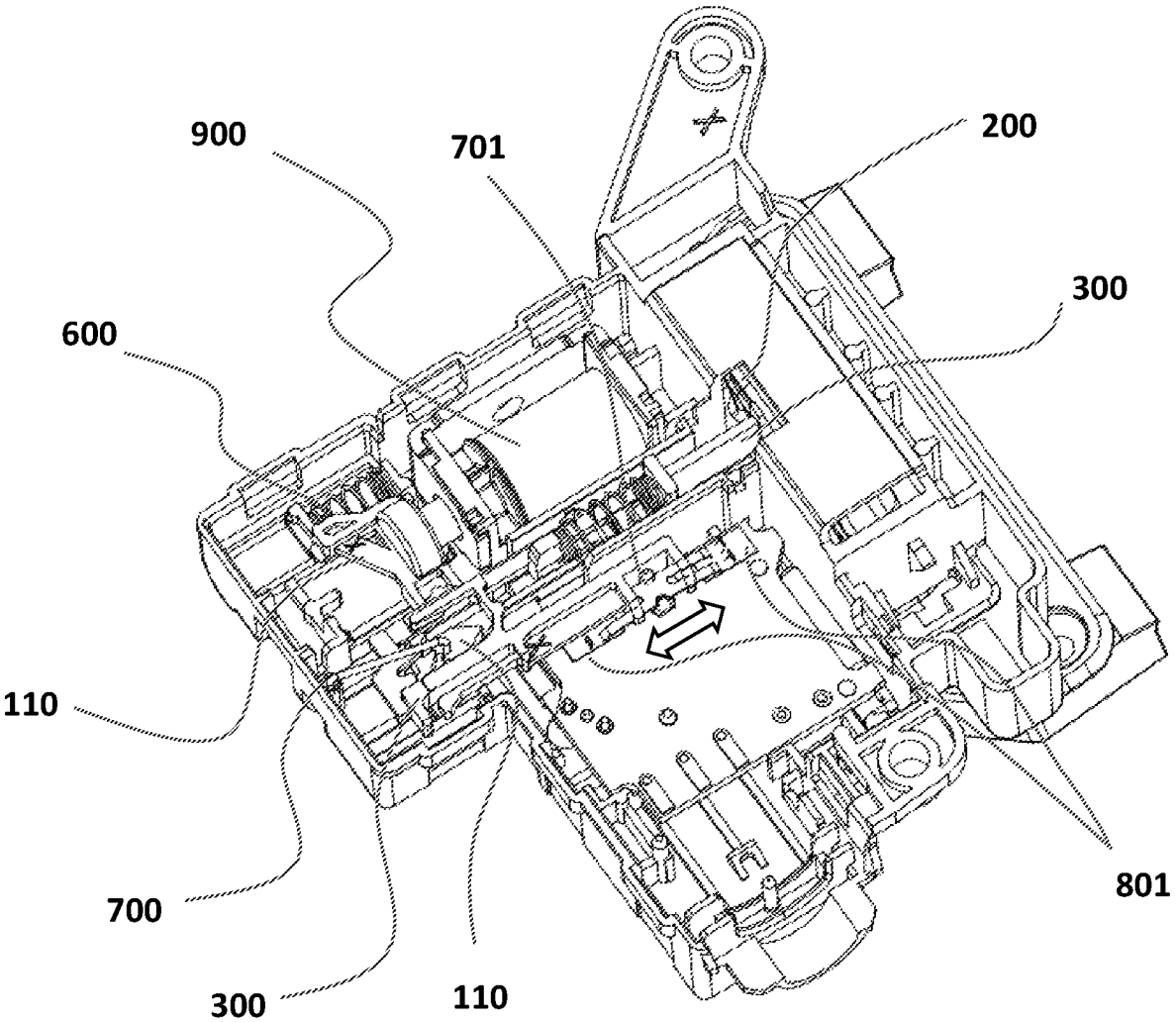
FIGS. 16*a* to 16*b* show a perspective view of the device according to an embodiment of the present invention at the end of the locking procedure.
Figure 16B:
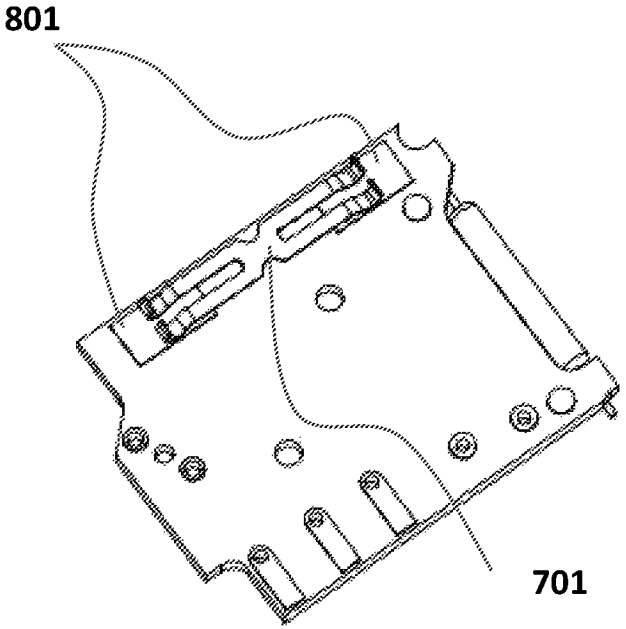

Reference numeral 1000 in FIGS. 11 to 20*c* globally indicates a closing and opening device, comprising a closing assembly 100 adapted to be fixed to a rigid part, for example of a household appliance (not depicted for reasons of clarity), wherein reference numeral 200 identifies a reference member adapted to be fixed to the hatch 2000 of said device, as depicted, for example, in FIG. 13*a* (see also FIG. 4). Said reference member 200 further comprises a cavity 201 adapted to be engaged by the end portion of a latch 110 of the assembly 100. To this end, the cross-sections (with respect to the translation direction of the latch 110) of the cavity 201 and of the end portion of the latch 110 have corresponding shapes and sizes, for example square, rectangular (as depicted) and/or similar shapes. Again, as depicted, the latch 110 is translatable (according to methods clarified in detail below) from a first end-stop position (FIGS. 11 and 12) to a second end-stop position (FIG. 15*b*) and is adapted to be positioned in an intermediate position (FIGS. 15*c* and 15*d*). Therefore, it arises that with the hatch 2000 in the closing position (FIG. 13*a*), and therefore with the reference member 200 positioned in front of the assembly 100 (with the cavity 201 on the translation trajectory of the latch 110), the switching by translation of the latch 110 from the first end-stop position in the, or at least towards the second end-stop position, results in the cavity 201 being engaged by the end portion of the latch 110, and therefore in the hatch 2000 being locked in the closing position.

Figure 18A:
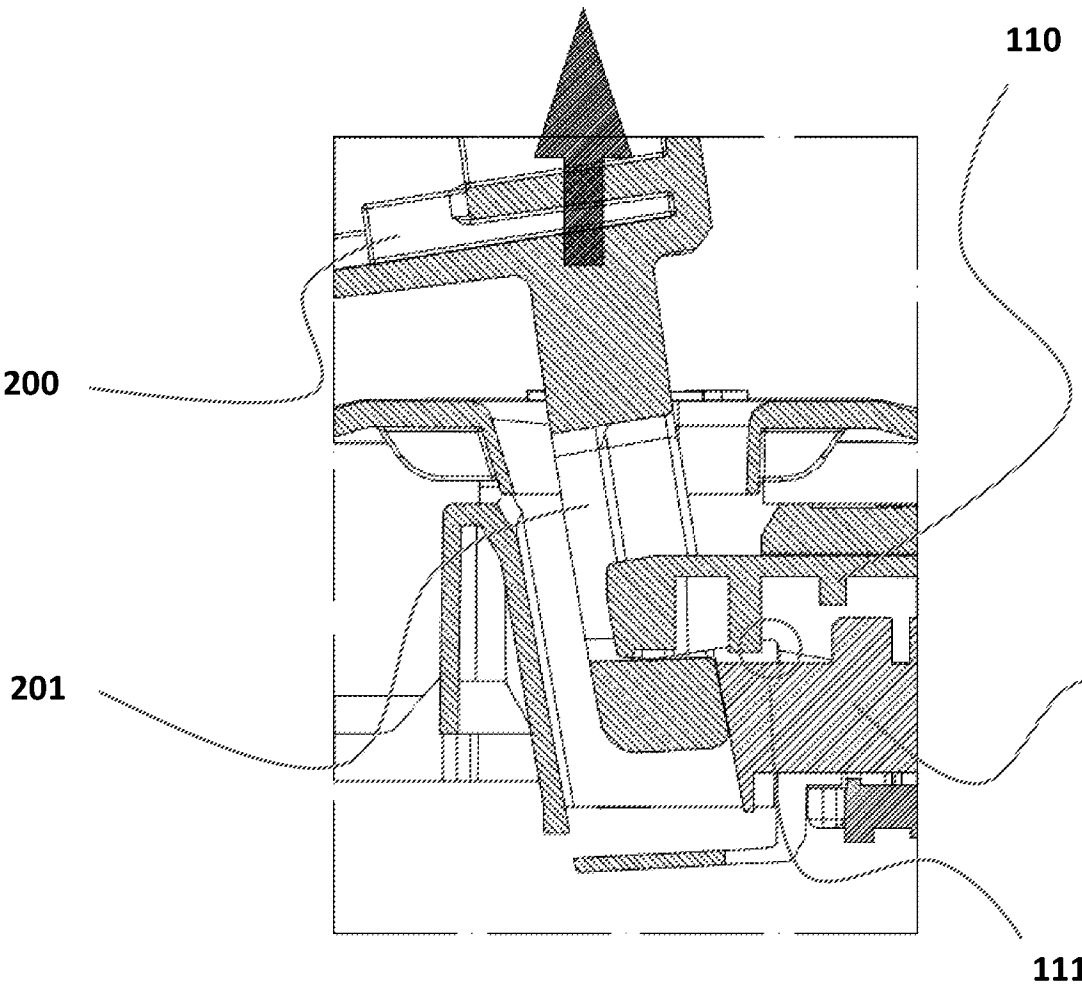
FIGS. 18*a* to 18*c* show a sectional view, a perspective view, and a side view of the latch of the device according to an embodiment of the present invention.
Figure 18B:
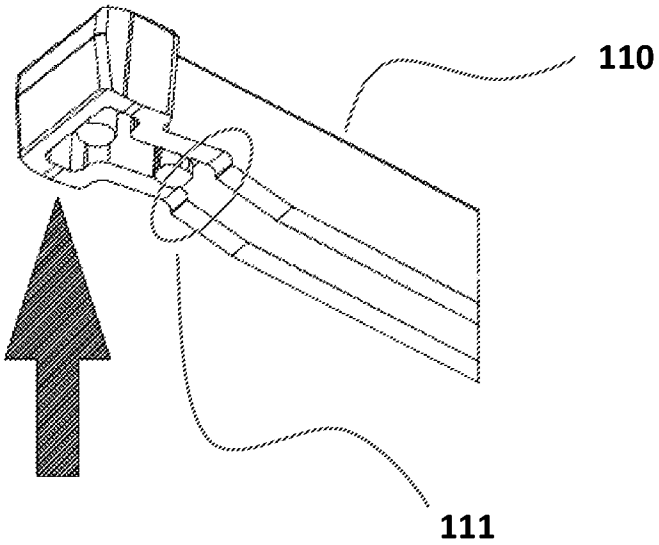
Figure 18C:
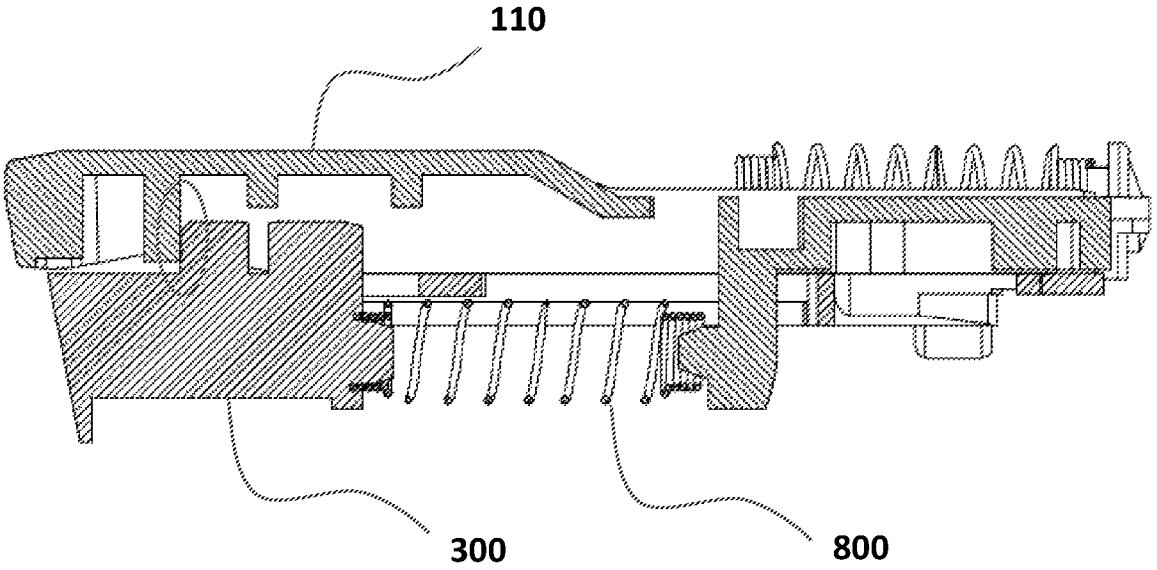
Figure 19A:
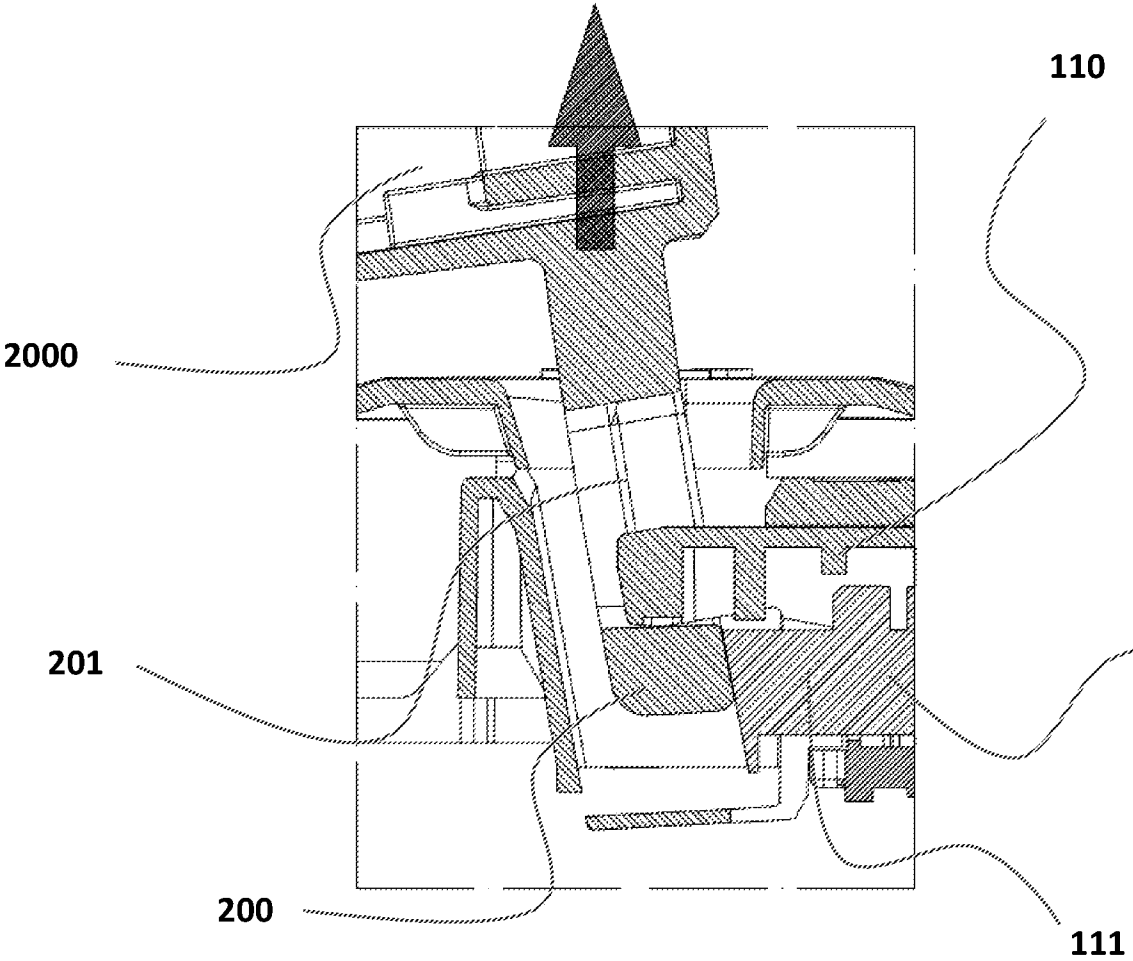
FIGS. 19*a* to 19*c* show sectional views of the latch and the permission element of the device according to an embodiment of the present invention in the case of breakage of the latch.
Figure 19B:
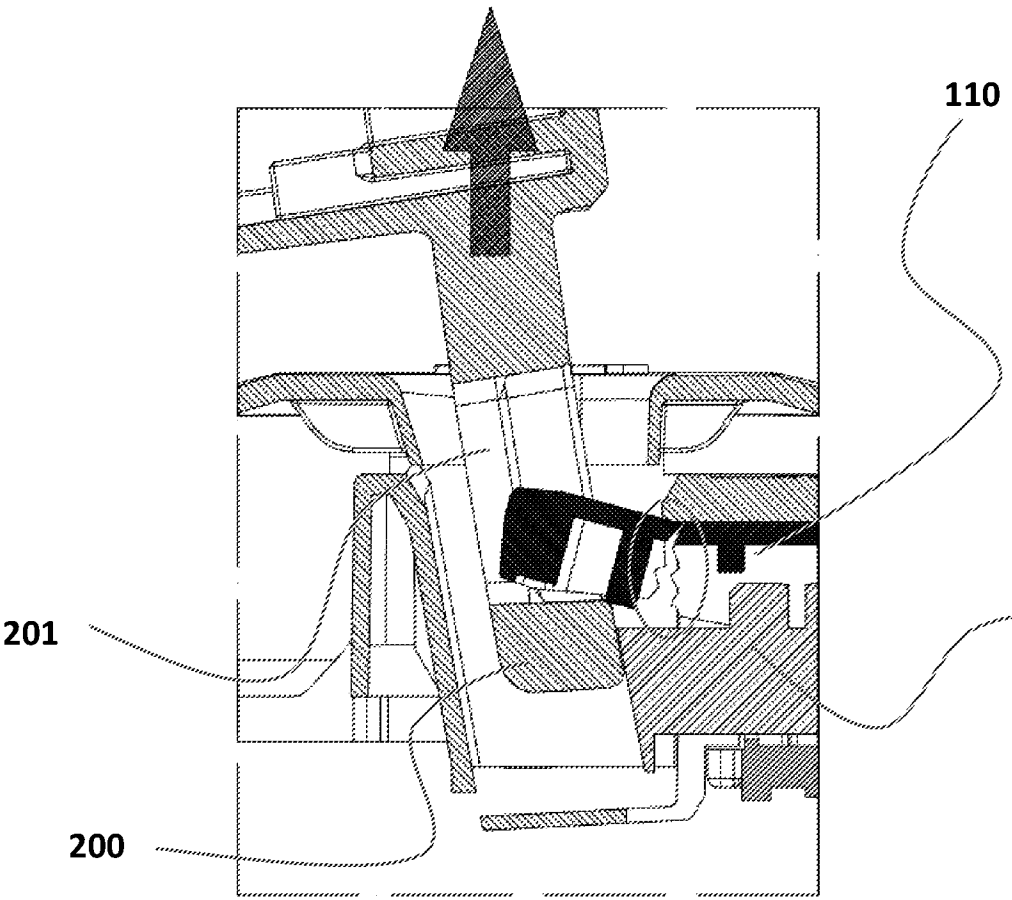
Figure 19C:
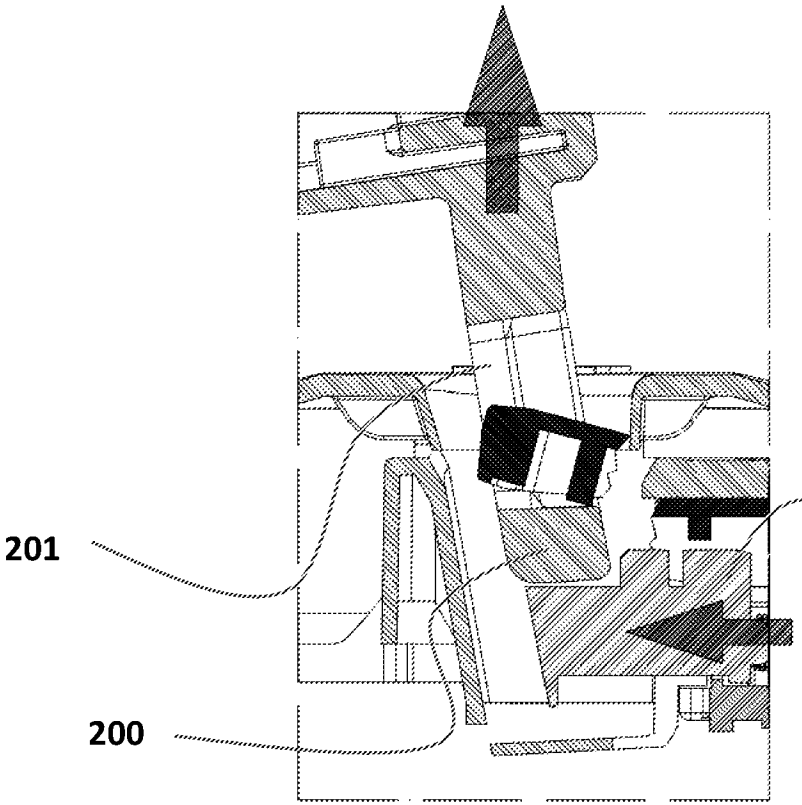

The assembly 100 further comprises a second slider 300 (FIGS. 18*a*-18*c*), hereinafter also identified as slider or permission element 300 for reasons which will become apparent in light of the following description, said slider 300 being adapted to be translated along a translation direction parallel to that of the latch 110, between a first own end-stop position thereof (FIGS. 11 and 12), and a second own end-stop position thereof (FIG. 19*c*). The translation of the latch 110 from the first end-stop position to the second end-stop position is obtained by activating a solenoid 900 which, when activated, acts in traction (from left to right with respect to FIGS. 11 and 12 and from right to left with respect to FIGS. 13*b* and 13*c*) on the latch 110 against the elastic resistance of a coil spring 600, while, instead, the deactivation of the solenoid 900 results in the automatic translation of the latch 110 towards the first end-stop position due to the elastic thrust of the spring 600. The slider 300, during the translation thereof between the first own end-stop position thereof and the second own end-stop position thereof, may be stopped, stationary, in a third intermediate own position thereof (FIG. 18*a*) without thereby interfering with the translation of the latch 110 which, instead, with the slider 300 locked in the third intermediate own position thereof, may be translated up to reach the second end-stop position and from the second end-stop position to the first end-stop position. The locking of the slider 300 in the third intermediate own position thereof occurs by interference with the reference member 200 according to the following methods and due to the fact that the slider 300, in particular (but not only), is pulled from the first end-stop own position thereof to the second end-stop own position thereof, by the latch 110; whether the slider 300, when it is pulled by the latch 110 to the second end-stop own position thereof, actually reaches said second end-stop own position thereof, or rather, is locked (stopped) in said third intermediate own position thereof, depends on the position of the hatch 2000 and of the corresponding reference member 200. In particular, if the hatch 2000 is not in the closing position (FIG. 19*c*), and therefore, if the reference member 200 is not in such a position as to be engaged by the latch 110, the slider 300 is pulled by the latch 110 until the latch 110 reaches the second end-stop own position thereof and the slider 300 also reaches the second end-stop own position thereof, in which it is stopped due to a mechanical abutment between the slider 300 and the head of the latch 110 (FIG. 18*c*); on the contrary, with the hatch 2000 in the closing position (FIG. 19*a*), and therefore with the reference member 200 in such a position as to be engaged by the latch 110, during the translation of the latch 110 towards the second end-stop position, and before the latch 110 reaches the second end-stop position, the slider 300 collides against the reference member 200 and is thus locked by the reference member 200 in said third intermediate own position thereof. If, with the hatch 2000 locked by the latch 110, the hatch 2000 is forced and switched into the opening position, causing the breakage of the reference member 200 (FIG. 19*c*), the slider 300 continues the travel thereof up to reach a fourth extra-travel position beyond the previously described second end-stop own position thereof; the reaching of said fourth extra-travel position by the slider 300 is due, in particular, to the fact that, after the breakage of the latch 110, the slider 300 is no longer locked in said second end-stop own position thereof by the above mechanical abutment. With reference to the figures, a description of the methods of switching the latch 110 and the slider 300 will be given below.

As depicted, a coil spring 800 is interposed between the latch 110 and the slider 300, wherein the translation of the latch 110 (generated by the activation of the solenoid 900) from the first end-stop position to the second end-stop position, thus results in a thrust exerted by the latch 110 on the coil spring 800, and therefore in a thrust exerted by the coil spring 800 on the slider 300 which is thus pulled to be translated by the latch 110 from the first end-stop own position thereof to the second end-stop own position thereof. Thus, again with reference to the previously described situation of open or absent hatch (with the reference member 200 not positioned at the assembly 100), it arises that in such a situation, the latch 110 may be translated up to reach the second end-stop position (FIG. 19*a*), and that the slider 300 is thus also pulled up to reach the second end-stop own position thereof.

On the contrary, with the hatch 2000 present in the closing position, and therefore with the reference member 200 positioned at the assembly 100, with the cavity 201 in a convenient position for being engaged by the free end portion of the latch 110, during the translation of the latch 110 towards the second end-stop position, the slider 300 hooks to the reference member 200 and is thus stopped by the reference member 200 in the third intermediate own position thereof; in particular, at the time of the impact of the slider 300 against the reference member 200 (or also against the hatch 2000), the latch 110 continues the translation thereof until it substantially reaches the second end-stop own position thereof, wherein, from the time of the impact of the slider 300 against the reference member 200, the further translation of the latch 110 results in a compression of the spring 800 which is thus elastically loaded.

A description of some of the further features of the device 100 according to the present invention will be given below, with reference to the drawings.

Firstly, it has to be considered that, on reaching the second end-stop position (FIGS. 15*b* and 18*a*), at the time of deactivating the solenoid 900, the latch 110 is pushed back towards the first end-stop position by the coil spring 600 up to reach said first end-stop position again (FIG. 15*a*) or, alternatively, a third intermediate position (FIG. 15*c*) depending on whether the slider 300 reaches the second end-stop own position thereof or is locked in the third intermediate own position thereof according to the previously described methods.

Figure 17A:
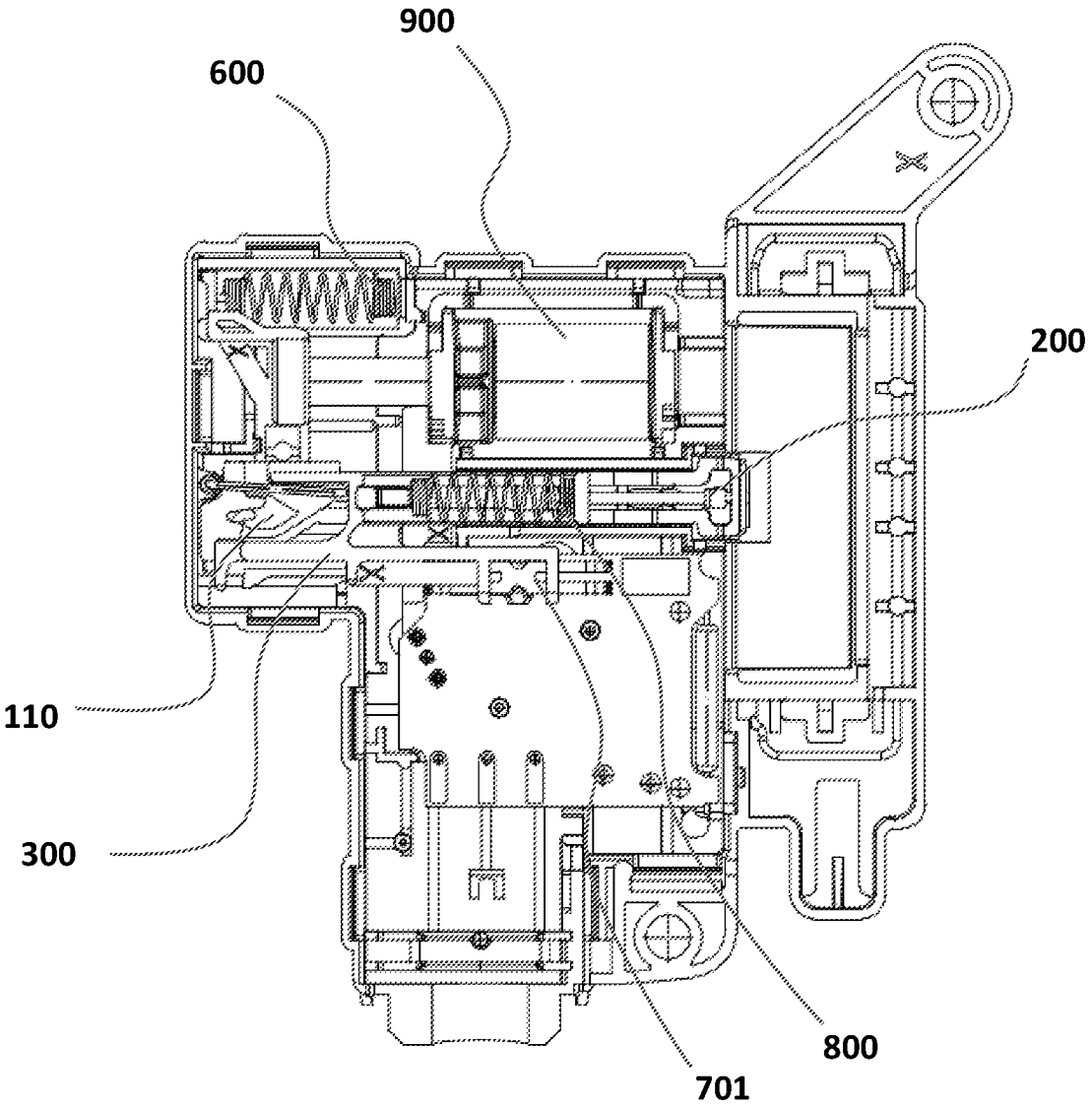
FIGS. 17*a* to 17*e* show plan views of the device according to an embodiment of the present invention and details thereof, respectively, in the case of enabling the closing and opening latch in the absence of the hatch.
Figure 17B:
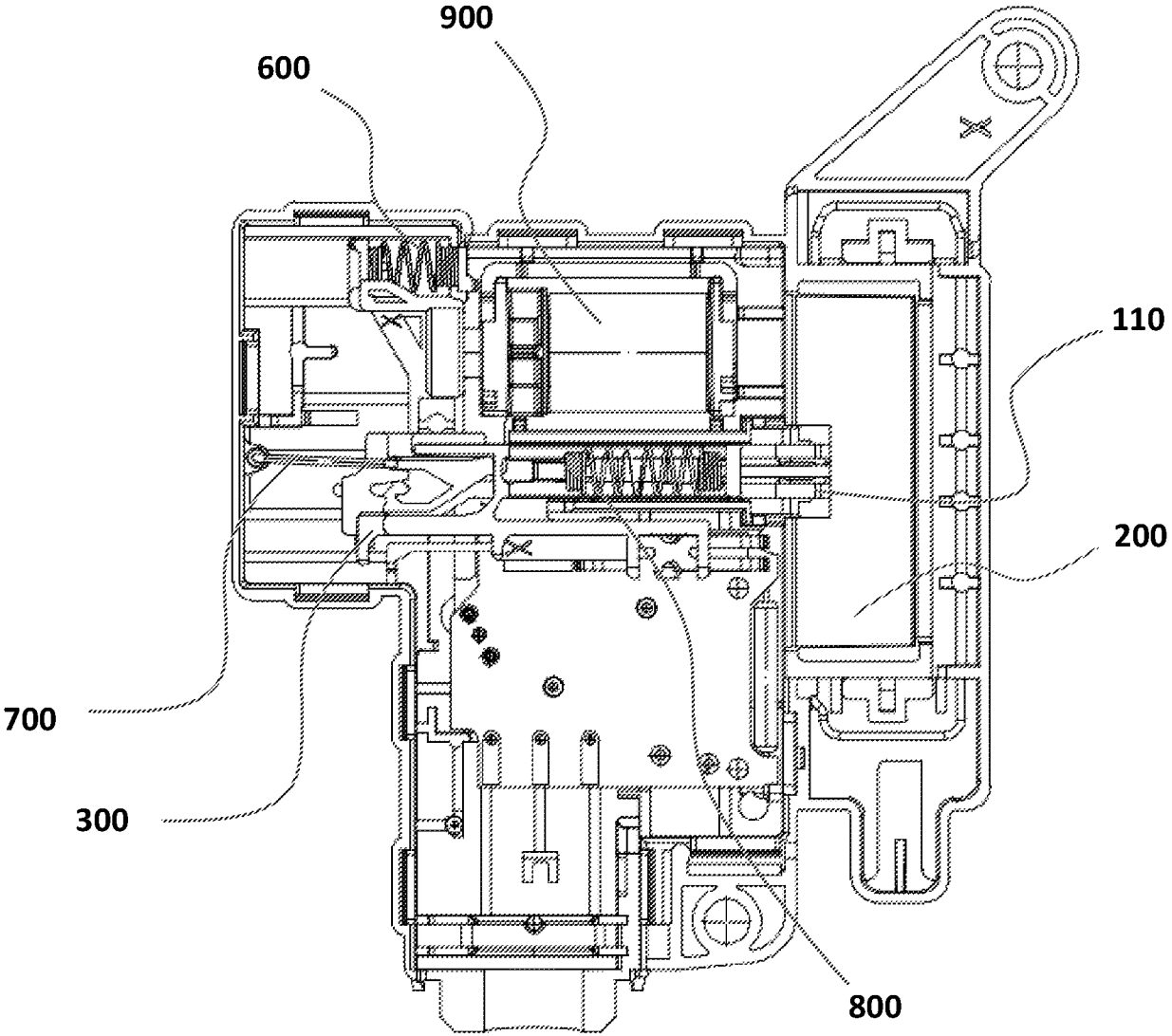
Figure 17C:
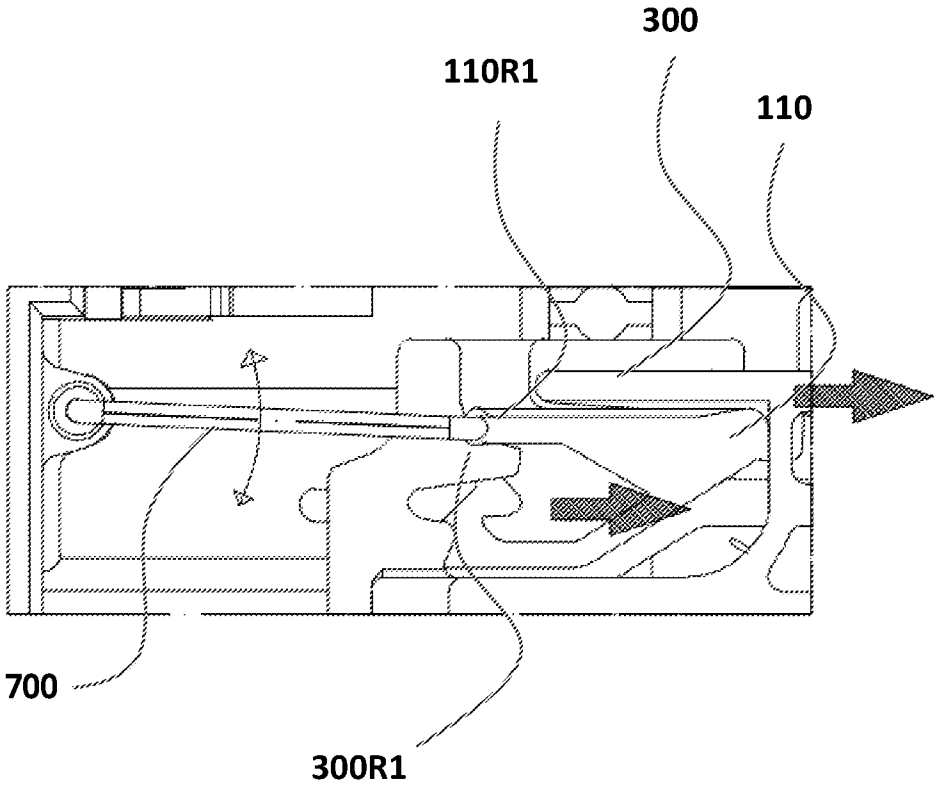

In fact, as depicted in particular in FIGS. 17*a* to 17*e*, the device 100 comprises a retaining spring 700 which is adapted to be rotated in two opposite directions as indicated by the double arrow in FIG. 17*c* between a first position (FIG. 17*a*) and a second position (FIG. 17*d*) rotated clockwise (with reference to the figures) with respect to said first position. In said first position, and with the latch 110 and the slider 300 in the corresponding first end-stop positions (FIG. 17*a*), said retaining spring 700 engages, without inhibiting the movement thereof, the latch 110 and the slider 300, wherein said latch 110 and slider 300 are thus free to be translated towards the corresponding second end-stop positions after the activation of the solenoid 900. In the case of the reference member 200 being absent, before reaching the corresponding second end-stop position, the slider 300 is locked in a position (also intermediate), in which the retaining spring 700 engages a first retaining seat 300R1 of the slider 300 (FIG. 17*c*). Being unable to rotate, the retaining spring 700 also locks the latch 110 during the translation thereof towards the second end-stop own position thereof, in an intermediate position (FIG. 17*c*), by the interaction with the sliding seat 110R1 obtained in the latch 110. Obviously, the deactivation of the solenoid results in the return of the latch 110 and the slider 300 to the corresponding first end-stop positions in FIG. 17*a* (according to the previously clarified methods), without the rotational switching of the retaining spring 700.

Figure 17D:
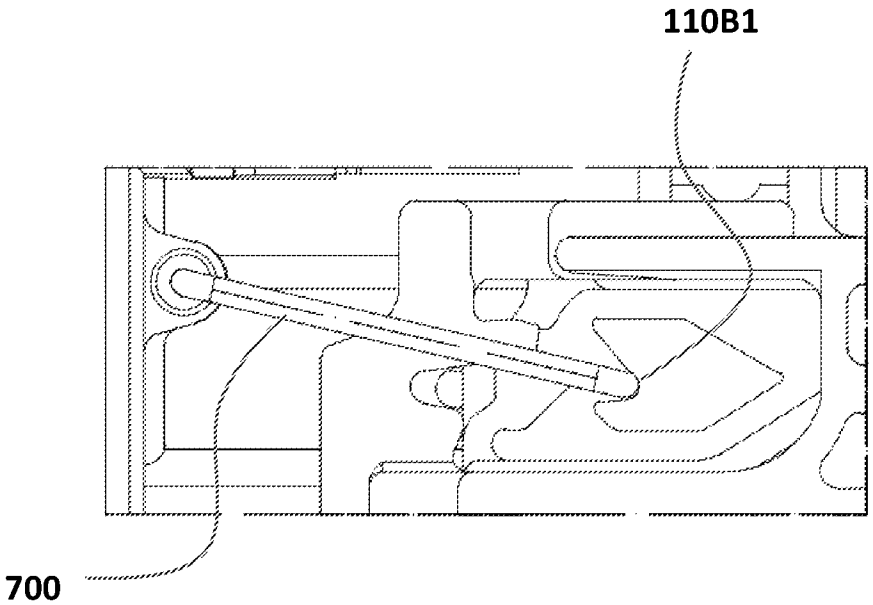
Figure 17E:
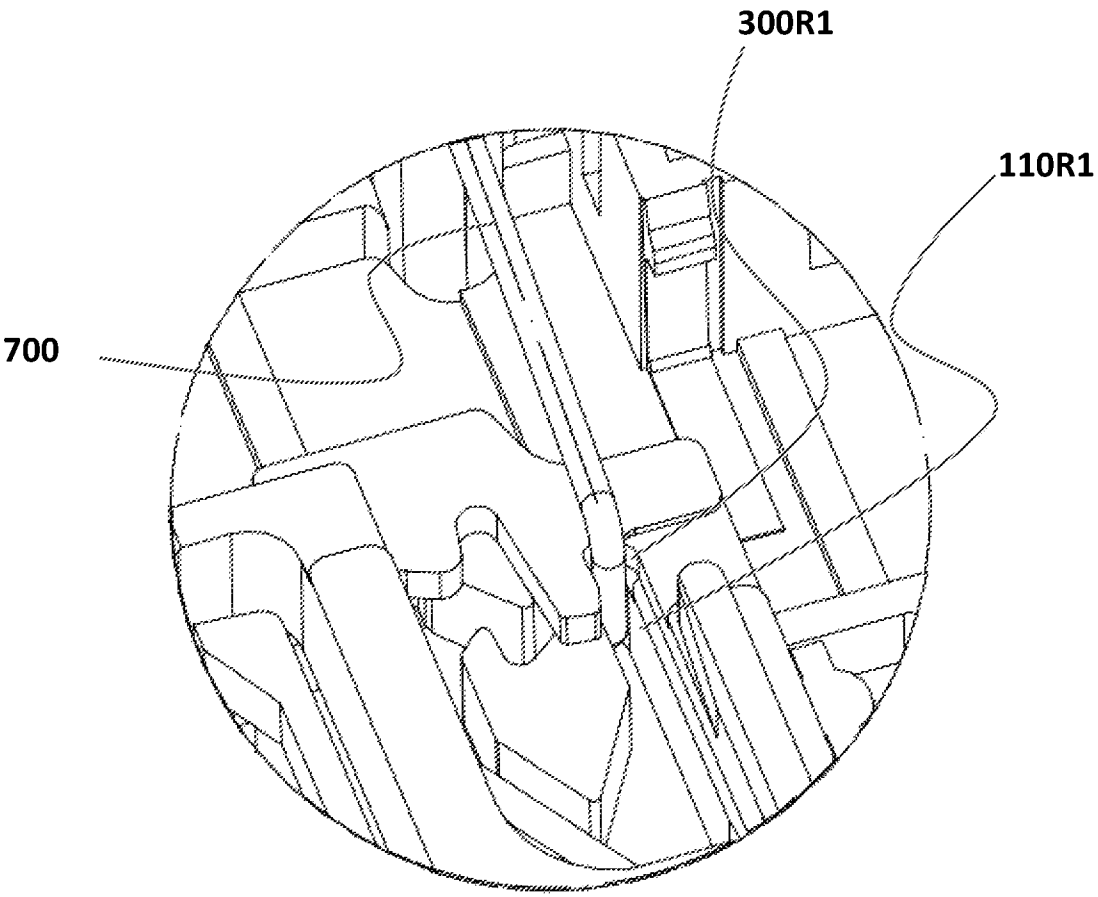

On the other hand, with the reference member 200 in the closing position, and that is, with the seat 201 at the latch 110, during the translation of the latch (operated by the solenoid 900) and the consequent pulling of the slider 300, when the slider 300 abuts against the reference member 200 (and is thus locked in the second intermediate position thereof), the spring 700 is still not engaged in the seat 300R1, therefore the further travel of the latch (towards the second end-stop position) results in a rotation of the retaining spring 700 (clockwise with reference to the drawings) from the first position to the second position under the thrust of a surface of the latch 110 which is tapered or oblique to the translation direction of the latch 110 and the slider 300. At this point, the deactivation of the solenoid 900 results in a brief translation of the latch 110 (due to the action of the spring 600) towards the first end-stop position, however, without the latch 110 reaching the first end-stop position; in fact, at this point, the retaining spring 700 is positioned at a locking seat 110B1 of the latch 110, wherein the latch 110, during the translation thereof towards the first end-stop position is thus locked (in an intermediate position between the first and second end-stop positions) by mutual engagement of the retaining spring 700 and said locking seat 110B1 of the latch 110 (FIG. 17*d*). Obviously, with the latch 110 locked according to the above methods, the slider 300 stays in the intermediate own position thereof, abutting against the reference member 300 under the thrust of the spring 800.

As depicted, for example, in FIGS. 11, 13*b*, 14*a* to 14*c*, and 17*a*, with the slider 300 in the first own end-stop position thereof, the sliding contacts 701 carried by the slider 300 are not in contact with the terminals 801, wherein the electric circuit (not shown) linked by the terminals 801 is open, and wherein the electric permission needed to enable the functions of the household appliance is thus not generated, the functions of the household appliance, in particular, the wash cycle, thus being inhibited.

On the contrary, with the permission slider 300 in the third intermediate position thereof (FIGS. 15*c* and 16*a* to 16*b*), the sliding contacts 701 carried by the slider 300 are in contact with the terminals 801, wherein the electric circuit linked by the terminals 801 is closed, and wherein the electric permission needed to enable the functions of the household appliance, in particular the wash cycle, which are thus possible, is thus generated (for example, by means of a control unit not depicted in the figures).

Further features of the device 100 according to the present invention are described below with reference to FIGS. 18*a* to 18*c* and 19*a* to 19*c*, wherein FIGS. 18*a* and 19*a* show the reference member 200 of the hatch 200 locked in the closing position by the latch 110 (in the third intermediate own position thereof) and engaged on thrust by the slider 300 (in the third intermediate own position thereof).

As anticipated, the latch 110 has a facilitated breakage point 111 (FIGS. 18*a* and 18*b*), wherein, when subjected to transverse loads equal to or greater than a predetermined load (for example, after a traction exerted by a user on the hatch 2000 and therefore in the direction of the arrow in FIG. 18*a*), the latch 110 breaks at the weak point 111 (FIGS. 19*b* and 19*c*), wherein the breakage of the latch 110 and the opening of the hatch 2000 result in the slider 300 being translated and pushed by the spring 800 up to reach the fourth extra-travel own position thereof (FIG. 19*c*), as it is no longer retained by the mechanical abutment between the slider 300 and the head of the latch 110 (FIG. 18*c*); the sliding contacts 701 carried by the slider 300 are thus translated until they are no longer in contact with the terminals 801, wherein the electric circuit linked by the terminals 801 is open, and wherein the electric permission needed to enable the functions of the household appliance is thus cancelled, the functions of the household appliance, in particular the wash cycle, thus being inhibited.

Figure 20A:
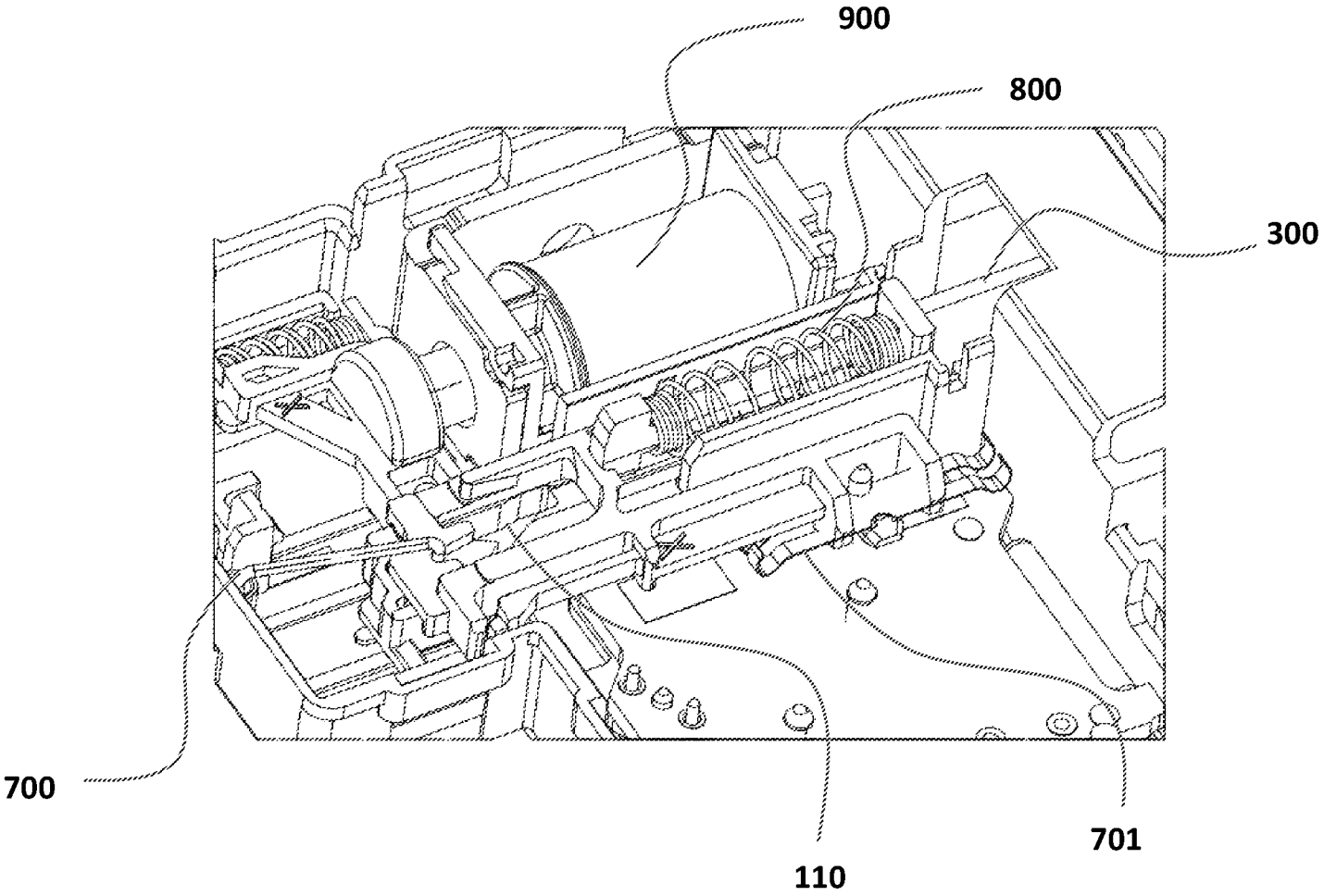
FIGS. 20*a* to 20*c* show perspective views of details of the device according to an embodiment of the present invention.
Figure 20B:
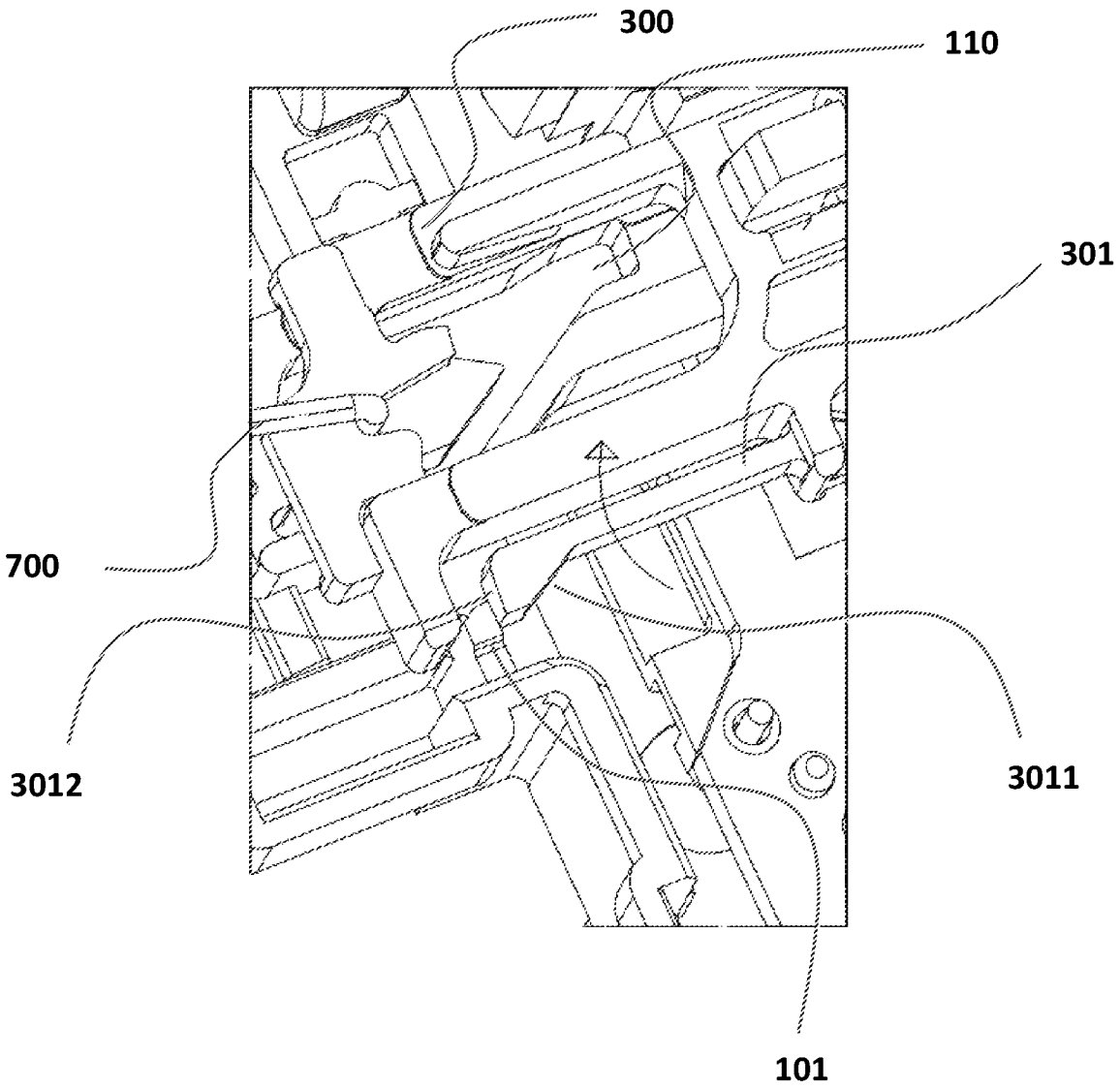
Figure 20C:
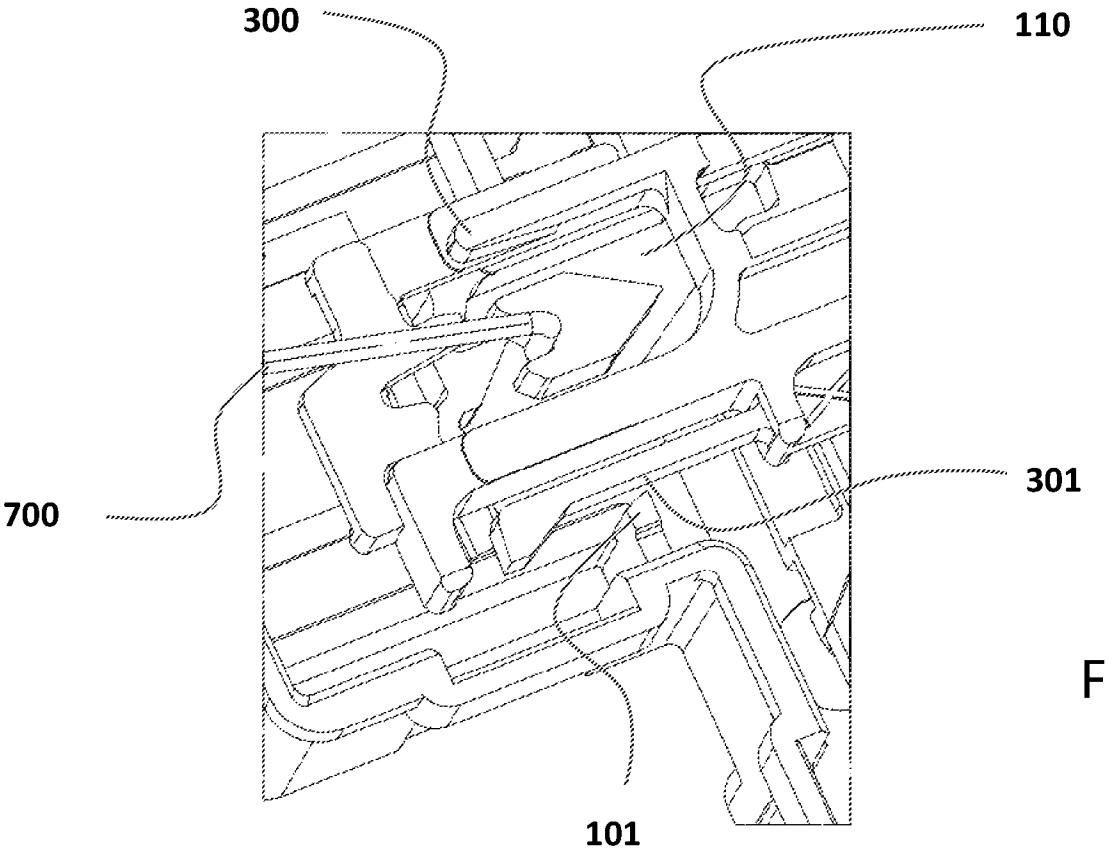

Furthermore, as shown in FIGS. 20*a*-20*c*, the device 100 according to the embodiment of the present invention depicted therein, has a solution for locking the slider 300 in the fourth extra-travel own position thereof (beyond the second end-stop own position thereof). In fact, imagine that the slider 300, from the third intermediate own position thereof, reaches the fourth extra-travel own position thereof, for example, after the breakage of the latch 110, as clarified previously; the slider 300, as depicted, has a flexible flap 301 which, in turn, has a tapered surface 3011 (oblique to the translation direction of the slider 300). Therefore, it arises that the translation of the slider 300 beyond the third intermediate own position thereof results in the flap 301 being switched (as indicated by the arrow in FIG. 20*b*) by contrast of the surface 3011 against a fixed reference member 101 of the device 100. When the surface 3011 passes the reference member 101, the flap returns, due to its elasticity, to the initial position in which a surface 3012 transverse to the translation direction of the slider 300 abuts against the reference member 101, further translations of the slider 300 to the first end-stop own position thereof being inhibited by the mutual contrast between the surface 3012 and the fixed reference member 101. This solution offers the advantage of inhibiting the slider 300 from being forcibly switched into the third intermediate own position thereof, with the hatch 2000 open and the slider 300 in the fourth extra-travel own position thereof, and thus inhibiting the functions of the household appliance (in particular, of the washing machine with top loading) from being enabled if the hatch 2000 is open.

Finally, according to a further embodiment, the device 200 has a magnetic field sensor 102, for example, an ampoule with two flexible electric terminals, wherein, according to said further embodiment, a magnet (for example, a permanent magnet not depicted in the figures) fixed to the reference member or hook 200 or to the hatch 2000 close to the reference member 200 is provided. Therefore, it arises that the closing of the hatch 2000 and the corresponding positioning of the magnet close to the ampoule 102 result in the flexible contacts of the ampoule 102 being electrically stressed which, coming into contact, close a corresponding electric circuit, which thus results, in turn, in the locking of the reference member 200 by the latch 110 and therefore in the enabling of the functions of the household appliance. On the contrary, in the case of a failed perception of the magnet by the ampoule 102, the contacts of the ampoule 102 stay open, the functionalities of the household appliance, in this case, being inhibited.

Finally, it is highlighted that according to the present invention it is possible to arrange the circuitry so that the activation of the solenoid 900 is inhibited with at least one of two circuits open, and so that the functionalities of the washing machine and the activation of the solenoid 900 are possible, instead, with both electric circuits closed.

Therefore, it has been demonstrated by the previous detailed description of the embodiments of the present invention, depicted in the drawings, that the present invention allows achieving the desired results and overcoming or at least reducing the drawbacks affecting the prior art.

In particular, a closing and opening device is provided by the present invention, which:

allows the reliable acknowledgement of the actual presence of the hatch in the closing position;

allows a reliable acknowledgement of the actual state of locking and releasing of the hatch;

inhibits the functions of the closing and opening device, in particular, inhibiting the switching of the permission element to the third intermediate position thereof in the case of a forced opening of the hatch with the possible breakage of the latch;

is characterized by manufacturing costs which are compatible with the needs of the market, small sizes, and overall volume, and is also applicable to household appliances of the known type according to equally simple methods and with equally low costs, without requiring substantial variations of said household appliances.

Although the present invention has been previously clarified by means of the detailed description of the embodiments shown in the drawings, the present invention is not limited to the embodiments described and shown in the drawings; on the contrary, all those variants and/or modifications of the embodiments described and shown in the accompanying drawings, which will be apparent to those skilled in the art, fall within the scope of the present invention.

The scope of protection of the present invention is thus defined by the claims.

The invention claimed is:

1. A device for closing and opening doors and/or hatches of household appliances, said device comprising:

a closing and opening assembly adapted to be fixed to one of a fixed part of an household appliance or a movable hatch of a said household appliance, and said closing and opening assembly including, a latch linearly movable between a first end-stop position and a second end-stop position and vice versa, said latch configured to engage a corresponding reference member mounted on said other of said fixed part or movable hatch, and a slider movable along a direction parallel to said direction of movement of said latch, the slider translatable between a first end-stop own position thereof and a second end-stop own position thereof and vice versa, said latch configured to pull said slider from said first end-stop own position to said second end-stop own position thereof against an elastic biasing means, wherein said slider, during a translation thereof from said first end-stop own position thereof to said second end-stop own position thereof, can be locked in a third intermediate own position thereof between said first end-stop own position thereof and second end-stop own position thereof, and wherein, with said slider locked in said third intermediate own position thereof, said latch, upon reaching said second end-stop position, is caused via said elastic biasing means to return to said first end-stop position and becomes locked in a third intermediate position between said first and second end-stop positions.

2. A device according to claim 1, wherein said latch, during a translation thereof from said first end-stop position to said second end-stop position, pulls said slider, causing said slider to be translated from the first end-stop own position thereof to the second end-stop own position thereof.

3. A device according to claim 1, wherein said elastic biasing means comprises a first elastic means, wherein a translation of said slider from said first end-stop position to said second end-stop position occurs against an elastic resistance of said first elastic means, and wherein a return of said latch from said second end-stop position to said first end-stop position is due to an elastic thrust of said first elastic means.

4. A device according to claim 3, wherein said device comprises second elastic retaining means which are rotatable between a first position and a second position, wherein with said slider locked in said third intermediate own position thereof, a return of said latch to said second end-stop position results in a movement of said second elastic retaining means from said first position to said second position, and wherein with said second elastic retaining means in said second position, said latch, during the return from said second end-stop position to said first end-stop position, is locked by said second elastic retaining means in said third intermediate position.

5. A device according to claim 4, wherein with said slider not locked in said third intermediate own position thereof, but instead free to translate to said second end-stop own position thereof, the return of said latch from said first end-stop position to said second end-stop position, and the translation of said slider from said first end-stop own position thereof to said second end-stop own position thereof do not result in the rotation of said second elastic retaining means from said first position to said second position, wherein said latch, during the return to said first end-stop position, is thus not locked by said second elastic retaining means in said third intermediate position, but reaches said first end-stop position.

6. A device according to claim 5, wherein said closing and opening assembly comprises third elastic means interposed between said latch and said slider, and wherein the return of said latch from said first end-stop position to said second end-stop position results in a thrust exerted by said latch on said third elastic means, and in a thrust exerted on said slider by said third elastic means.

7. A device according to claim 6, wherein a locking of said slider in said third intermediate own position thereof does not interfere with the return of said latch towards said second end-stop position, wherein, instead, with said slider locked in said third intermediate own position thereof, said latch is movable with respect to said slider.

8. A device according to claim 7, wherein with said slider locked in said third intermediate own position thereof, the return of said latch to said second position occurs against an elastic resistance exerted by said third elastic means.

9. A device according to claim 8, wherein said slider, with said latch in the third intermediate position, is locked in said third intermediate own position thereof, and wherein, in case of breakage of said latch, said slider is adapted to be locked in an extra-travel position beyond said second end-stop position.

10. A device according to claim 9, wherein said slider comprises an elastic tongue which is elastically deformable between a first position and a second position, wherein said closing and opening assembly comprises a fixed contrast portion, and wherein the translation of said slider towards said second end-stop own position thereof and beyond said third intermediate own position thereof results in said elastic tongue changing from said first position to said second position by contrast against said fixed contrast portion of said closing and opening assembly.

11. A device according to claim 10, wherein said elastic tongue passing beyond said fixed contrast portion results in causing said elastic tongue to change from said second position to said first position and in said slider being locked by contrast between said elastic tongue and said fixed part.

12. A device according to claim 1, wherein said device comprises a first electric circuit, a closing of which results in at least one function of a household appliance being enabled, and wherein said a first electric circuit is electrically closed with said slider locked in said third intermediate own position thereof.

13. A device according to claim 12, wherein said first circuit comprises a plurality of terminals, wherein said device comprises at least one contact element fixed to said slider, and wherein only with said slider locked in said third intermediate own position thereof, said first electric circuit is electrically closed by mutual contact between said terminals of said first electric circuit and said at least one contact element.

14. A device according to claim 1, wherein said latch has a predetermined breaking point, and wherein said latch breaks at said predetermined breaking point if said latch is subjected to transverse loads equal to or greater than a predetermined transverse load.

15. A device according to claim 1, wherein said closing and opening assembly comprises a magnetic field sensor adapted to perceive permanent magnet.

16. A device according to claim 15, wherein said device comprises a second electric circuit, a closing of said second electric circuit resulting in at least one function of said household appliance being enabled, and wherein said second electric circuit is electrically closed by said magnetic field sensor upon perceiving said permanent magnet.

17. A system for closing and opening doors and/or hatches of household appliances, said system comprising:

said reference member adapted to be fixed firmly to a hatch and/or a fixed part of a household appliance, wherein said system comprises a closing and opening device according to claim 1, and wherein said reference member is adapted to be alternately engaged with and disengaged from said latch.

18. A system according to claim 17, wherein said reference member defines a cavity, and wherein said latch comprises an end portion adapted to be housed in said cavity.

19. A system according to claim 18, wherein said reference member defines an engagement element configured to be engaged by said slider during the translation thereof from said first end-stop own position thereof to said second end-stop own position thereof, and to lock said slider in said third intermediate own position thereof.

20. A household appliance comprising;

a hatch which is movable between a first opening position and a second closing position, wherein said household appliance comprises a system according to claim 17, wherein said reference member is fixed to said hatch or to the fixed part of said household appliance, wherein said device is fixed to the fixed part of said household appliance or to said hatch of said household appliance, respectively, and wherein said reference member and device are mutually positioned so that, with said hatch in said second closing position, said reference member becomes engaged by said latch in said second closing position and by said slider in said third intermediate own position thereof.

* * * * *